US009256168B2

(12) United States Patent
Tanaka

(10) Patent No.: US 9,256,168 B2
(45) Date of Patent: Feb. 9, 2016

(54) IMAGE FORMING APPARATUS

(71) Applicant: Shinya Tanaka, Kanagawa (JP)

(72) Inventor: Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/594,531

(22) Filed: Jan. 12, 2015

(65) Prior Publication Data

US 2015/0212453 A1 Jul. 30, 2015

(30) Foreign Application Priority Data

Jan. 24, 2014 (JP) ..... 2014-011124
Oct. 22, 2014 (JP) ..... 2014-215590

(51) Int. Cl.
*G03G 15/16* (2006.01)
*G03G 21/20* (2006.01)

(52) U.S. Cl.
CPC ..... *G03G 15/1675* (2013.01); *G03G 15/1605* (2013.01); *G03G 21/203* (2013.01)

(58) Field of Classification Search
USPC ..... 399/38, 44, 45, 66
See application file for complete search history.

(56) References Cited

U.S. PATENT DOCUMENTS

2008/0232859 A1* 9/2008 Sakata et al. ..... 399/270
2012/0230715 A1 9/2012 Ogino et al.
2012/0237234 A1* 9/2012 Sugimoto et al. ..... 399/50
2012/0328314 A1 12/2012 Sugimoto et al.
2012/0328321 A1 12/2012 Takeuchi et al.
2013/0064559 A1 3/2013 Nakamura et al.
2013/0089363 A1 4/2013 Mimbu et al.
2013/0121714 A1 5/2013 Tanaka et al.
2013/0136468 A1 5/2013 Shimizu et al.
2013/0136477 A1 5/2013 Ogiyama et al.
2013/0142531 A1 6/2013 Sugimoto et al.
2013/0148993 A1 6/2013 Aoki et al.
2013/0164011 A1 6/2013 Nakamura et al.
2013/0177329 A1 7/2013 Tanaka et al.
2013/0182269 A1 7/2013 Tanaka
2013/0195483 A1 8/2013 Shimizu et al.

(Continued)

FOREIGN PATENT DOCUMENTS

JP 2006-267486 10/2006
JP 2012-237974 12/2012
JP 2013-127592 6/2013

OTHER PUBLICATIONS

U.S. Appl. No. 14/256,178, filed Apr. 18, 2014.

(Continued)

*Primary Examiner* — Hoan Tran
(74) *Attorney, Agent, or Firm* — Oblon, McClelland, Maier & Neustadt, L.L.P

(57) ABSTRACT

An image forming apparatus includes a power source and a controller. A time-averaged value (Vave) of a voltage output from the power source has a polarity in a transfer direction, and an absolute value of Vave is greater than a midpoint value (Voff) of the voltage intermediate between a maximum value and a minimum value of the voltage. With an increase in a difference (Vpp) between the maximum value and the minimum value of the voltage, the controller controls the power source to increase a duty ratio (Duty) expressed by A/(A+B), where A is an application time in one cycle at a return direction side opposite a transfer direction side relative to Voff and B is an application time at the transfer direction side relative to Voff, and with a decrease in (Vpp), the controller controls the power source to reduce Duty.

13 Claims, 26 Drawing Sheets

(56) References Cited

U.S. PATENT DOCUMENTS

| | | | | |
|---|---|---|---|---|
| 2013/0216281 | A1 | 8/2013 | Suzuki et al. | |
| 2013/0236201 | A1 | 9/2013 | Mizutani et al. | |
| 2013/0279939 | A1* | 10/2013 | Nagamori ..... | H01B 5/02 399/171 |
| 2013/0308968 | A1 | 11/2013 | Tanaka et al. | |
| 2014/0010562 | A1 | 1/2014 | Tanaka et al. | |
| 2014/0029988 | A1 | 1/2014 | Shimizu et al. | |
| 2014/0079418 | A1* | 3/2014 | Tanaka et al. ..... | 399/44 |
| 2014/0169817 | A1 | 6/2014 | Sugimoto et al. | |
| 2014/0248064 | A1 | 9/2014 | Tanaka et al. | |
| 2014/0314435 | A1 | 10/2014 | Kato et al. | |

OTHER PUBLICATIONS

U.S. Appl. No. 14/259,337, filed Apr. 23, 2014.

* cited by examiner

| SHEET TYPE | DEPTH OF RECESS (μm) |
|---|---|
| LEATHAC 100g | 85 |
| LEATHAC 130kg | 101 |
| LEATHAC 175kg | 112 |

FIG. 28A

| | RECESS | PAPER TYPE | Vpp (kV) | duty (%) | TRANSFERABILITY AT RECESS | ELECTRICAL DISCHARGE |
|---|---|---|---|---|---|---|
| EMBODIMENT 1 | SMALL | LEATHAC 100g | 6 | 12 | GOOD | GOOD |
| | MEDIUM | LEATHAC 130kg | 7 | 13 | GOOD | GOOD |
| | LARGE | LEATHAC 175kg | 8 | 14 | GOOD | GOOD |

FIG. 28B

| | RECESS | PAPER TYPE | Vpp (kV) | duty (%) | TRANSFERABILITY AT RECESS | ELECTRICAL DISCHARGE |
|---|---|---|---|---|---|---|
| COMPARATIVE EXAMPLE 1 | SMALL | LEATHAC 100g | 6 | 12 | GOOD | GOOD |
| | MEDIUM | LEATHAC 130kg | 6 | 12 | FAIR | GOOD |
| | LARGE | LEATHAC 175kg | 6 | 12 | POOR | GOOD |

FIG. 29A

| | THICKNESS | PAPER TYPE | Vpp (kV) | duty (%) | TRANSFERABILITY AT RECESS | ELECTRICAL DISCHARGE |
|---|---|---|---|---|---|---|
| EMBODIMENT 2 | THIN | LEATHAC 100g | 6 | 12 | GOOD | GOOD |
| | MEDIUM | LEATHAC 130kg | 7 | 13 | GOOD | GOOD |
| | THICK | LEATHAC 175kg | 8 | 14 | GOOD | GOOD |

FIG. 29B

| | THICKNESS | PAPER TYPE | Vpp (kV) | duty (%) | TRANSFERABILITY AT RECESS | ELECTRICAL DISCHARGE |
|---|---|---|---|---|---|---|
| COMPARATIVE EXAMPLE 2 | THIN | LEATHAC 100g | 6 | 12 | GOOD | GOOD |
| | MEDIUM | LEATHAC 130kg | 8 | 12 | FAIR | GOOD |
| | THICK | LEATHAC 175kg | 10 | 12 | POOR | GOOD |
| | THICK | LEATHAC 175kg | 11 | 12 | FAIR | POOR |
| | THICK | LEATHAC 175kg | 12 | 12 | GOOD | POOR |

FIG. 30A

| | TEMPERATURE AND HUMIDITY | Vpp (kV) | duty (%) | TRANSFERABILITY AT RECESS | ELECTRICAL DISCHARGE |
|---|---|---|---|---|---|
| EMBODIMENT 3 | 27°C 80% | 6 | 12 | GOOD | GOOD |
| | 23°C 50% | 8 | 14 | GOOD | GOOD |
| | 10°C 15% | 10 | 15 | GOOD | GOOD |

FIG. 30B

| | TEMPERATURE AND HUMIDITY | Vpp (kV) | duty (%) | TRANSFERABILITY AT RECESS | ELECTRICAL DISCHARGE |
|---|---|---|---|---|---|
| COMPARATIVE EXAMPLE 3 | 27°C 80% | 6 | 12 | GOOD | GOOD |
| | 23°C 50% | 6 | 12 | FAIR | GOOD |
| | 10°C 15% | 6 | 12 | POOR | GOOD |

FIG. 30C

| | TEMPERATURE AND HUMIDITY | Vpp (kV) | duty (%) | TRANSFERABILITY AT RECESS | ELECTRICAL DISCHARGE |
|---|---|---|---|---|---|
| COMPARATIVE EXAMPLE 4 | 27°C 80% | 6 | 12 | GOOD | GOOD |
| | 23°C 50% | 8 | 12 | FAIR | GOOD |
| | 10°C 15% | 10 | 12 | POOR | GOOD |
| | 10°C 15% | 11 | 12 | FAIR | POOR |
| | 10°C 15% | 12 | 12 | GOOD | POOR |

FIG. 31A

| | RESISTANCE | duty (%) | Vpp | | |
|---|---|---|---|---|---|
| | | | TARGET VALUE | MEASURED VALUE | TRANSFERABILITY AT RECESS |
| EMBODIMENT 4 | 8.5 | 20 | 12 | 12.2 | EXCELLENT |
| | 8.0 | 18 | 11 | 11.0 | EXCELLENT |
| | 7.5 | 16 | 10 | 10.0 | EXCELLENT |

FIG. 31B

| | RESISTANCE | duty (%) | Vpp | | |
|---|---|---|---|---|---|
| | | | TARGET VALUE | MEASURED VALUE | TRANSFERABILITY AT RECESS |
| COMPARATIVE EXAMPLE 5 | 8.5 | 8 | 8 | 7.4 | POOR |
| | 8.0 | 8 | 8 | 7.4 | POOR |
| | 7.5 | 8 | 8 | 7.4 | FAIR |

FIG. 31C

| | RESISTANCE | duty (%) | Vpp | | |
|---|---|---|---|---|---|
| | | | TARGET VALUE | MEASURED VALUE | TRANSFERABILITY AT RECESS |
| COMPARATIVE EXAMPLE 6 | 8.5 | 8 | 12 | 8.1 | POOR |
| | 8.0 | 8 | 11 | 8.1 | FAIR |
| | 7.5 | 8 | 10 | 8.1 | GOOD |

FIG. 36

| | | Vpp (kV) | |
|---|---|---|---|
| | duty (%) | TARGET VALUE | MEASURED VALUE |
| COMPARATIVE EXAMPLE | 8 | 6 | 5.9 |
| | 8 | 7 | 6.5 |
| | 8 | 8 | 7.4 |
| | 8 | 9 | 8.0 |
| | 8 | 10 | 8.1 |
| | 8 | 11 | 8.1 |
| | 8 | 12 | 8.1 |
| EMBODIMENT | 8 | 6 | 5.9 |
| | 10 | 7 | 7.0 |
| | 12 | 8 | 8.0 |
| | 14 | 9 | 9.1 |
| | 16 | 10 | 10.0 |
| | 18 | 11 | 11.0 |
| | 20 | 12 | 12.2 |

FIG. 37

| Vr (kV) | Vave (kV) | duty (%) | Vt (kV) |
|---|---|---|---|
| 3 | −2 | 10 | −2.56 |
| 3 | −2 | 15 | −2.88 |
| 3 | −2 | 20 | −3.25 |
| 3 | −2 | 25 | −3.67 |
| 3 | −2 | 30 | −4.14 |
| 3 | −2 | 35 | −4.69 |
| 3 | −2 | 40 | −5.33 |
| 3 | −2 | 45 | −6.09 |
| 3 | −2 | 50 | −7.00 |

IMAGE FORMING APPARATUS

CROSS-REFERENCE TO RELATED APPLICATIONS

This patent application is based on and claims priority pursuant to 35 U.S.C. §119 from Japanese Patent Application Nos. 2014-011124, filed on Jan. 24, 2014, and 2014-215590, filed on Oct. 22, 2014, both in the Japan Patent Office, which are hereby incorporated herein by reference in their entirety.

BACKGROUND

1. Technical Field

Exemplary aspects of the present disclosure generally relate to an image forming apparatus in which a toner image on an image bearer is transferred onto a recording medium in a transfer nip defined by the image bearing member and a transfer device.

2. Description of the Related Art

There is known an image forming apparatus using an electrophotographic method in which a transfer bias is applied to a transfer nip formed opposite to an image bearer to transfer a toner image on a surface of an image bearer onto a recording medium. In such a configuration, when using a recording medium having a coarse surface such as Japanese paper (also known as Washi), a pattern of light and dark according to the surface condition of the recording medium appears in an output image. Toner does not transfer well to such embossed surfaces, in particular, recessed portions of the surface. As a result, the image density at the recessed portions is lower than the image density at projecting portions. This inadequate transfer of the toner appears as the pattern of light and dark patches in the resulting output image.

SUMMARY

In view of the foregoing, in an aspect of this disclosure, there is provided an improved (or novel) image forming apparatus including an image bearer, a transfer device, a power source, and a controller. The image bearer bears a toner image on a surface thereof. The transfer device contacts the image bearer to form a transfer nip. The power source outputs a voltage to transfer the toner image from the image bearer onto a recording medium interposed in the transfer nip. The voltage includes a first voltage in a transfer direction in which the toner image is transferred from the image bearer to the recording medium and a second voltage having a polarity opposite that of the first voltage, and the first voltage and the second voltage alternate upon transfer of the toner image from the image bearer to the recording medium. The controller is operatively connected to the power source to control the power source. A time-averaged value (Vave) of the voltage has a polarity in the transfer direction, and an absolute value of the time-averaged value (Vave) is greater than a midpoint value (Voff) of the voltage intermediate between a maximum value and a minimum value of the voltage. With an increase in a difference (Vpp) between the maximum value and the minimum value of the voltage, the controller controls the power source to increase a duty ratio (Duty) expressed by B/(A+B), where B is an application time in one cycle at a return direction side opposite a transfer direction side relative to the midpoint value (Voff) and A is an application time at the transfer direction side relative to the midpoint value (Voff), and with a decrease in the difference (Vpp), the controller controls the power source to reduce the duty ratio (Duty).

According to another aspect, an image forming apparatus includes an image bearer, a power source, a waveform setting device, and a controller. The image bearer bears a toner image on a surface thereof. The power source outputs an oscillation voltage to transfer the toner image from the image bearer onto a recording medium. The waveform setting device sets a waveform of the oscillation voltage. The waveform setting device sets the waveform to increase a time ratio expressed by Y/X with an increase in a voltage difference (Vpp) between a maximum value of the waveform and a minimum value of the waveform, where X is a cycle of the waveform and Y is a time during which the waveform has a polarity causing the toner image to return from the recording medium to the image bearer in the cycle X. The controller is operatively connected to the power source to control an output of the power source including the oscillation voltage based on the waveform set by the waveform setting device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 28A is a table showing effects of Embodiment 1 in which a sheet type, a duty, and a peak-to-peak voltage (Vpp) are varied;

FIG. 28B is a table showing effects of Comparative Example 1 in which the sheet type is varied;

FIG. 29A is a table showing effects of Embodiment 2 in which a thickness of the recording medium, the duty, and the peak-to-peak voltage (Vpp) are varied;

FIG. 29B is a table showing effects of Comparative Example 2 in which the thickness and the peak-to-peak voltage (Vpp) are varied;

FIG. 30A is a table showing effects of Embodiment 3 in which temperature, humidity, the duty, and the peak-to-peak voltage are varied;

FIG. 30B is a table showing effects of Comparative Example 3 in which the temperature and the humidity are varied;

FIG. 30C is a table showing effects of Comparative Example 4 in which the temperature, the humidity, and the peak-to-peak voltage (Vpp) are varied;

FIG. 31A is a table showing effects of Embodiment 4 in which an electrical resistance at the transfer nip, the duty, and the peak-to-peak voltage (Vpp) are varied;

FIG. 31B is a table showing effects of Comparative Example 5 in which the electrical resistance is varied;

FIG. 31C is a table showing effects of Comparative Example 6 in which the electrical resistance and the peak-to-peak voltage (Vpp) are varied;

FIG. 36 is a table showing changes in the duty, and target and measured values of the peak-to-peak voltage (Vpp);

FIG. 37 is a table showing changes in a transfer-direction peak value Vt when the duty is changed while a return peak value Vr and a time-averaged value Vave of the voltage are fixed;

DETAILED DESCRIPTION

Figure 1:
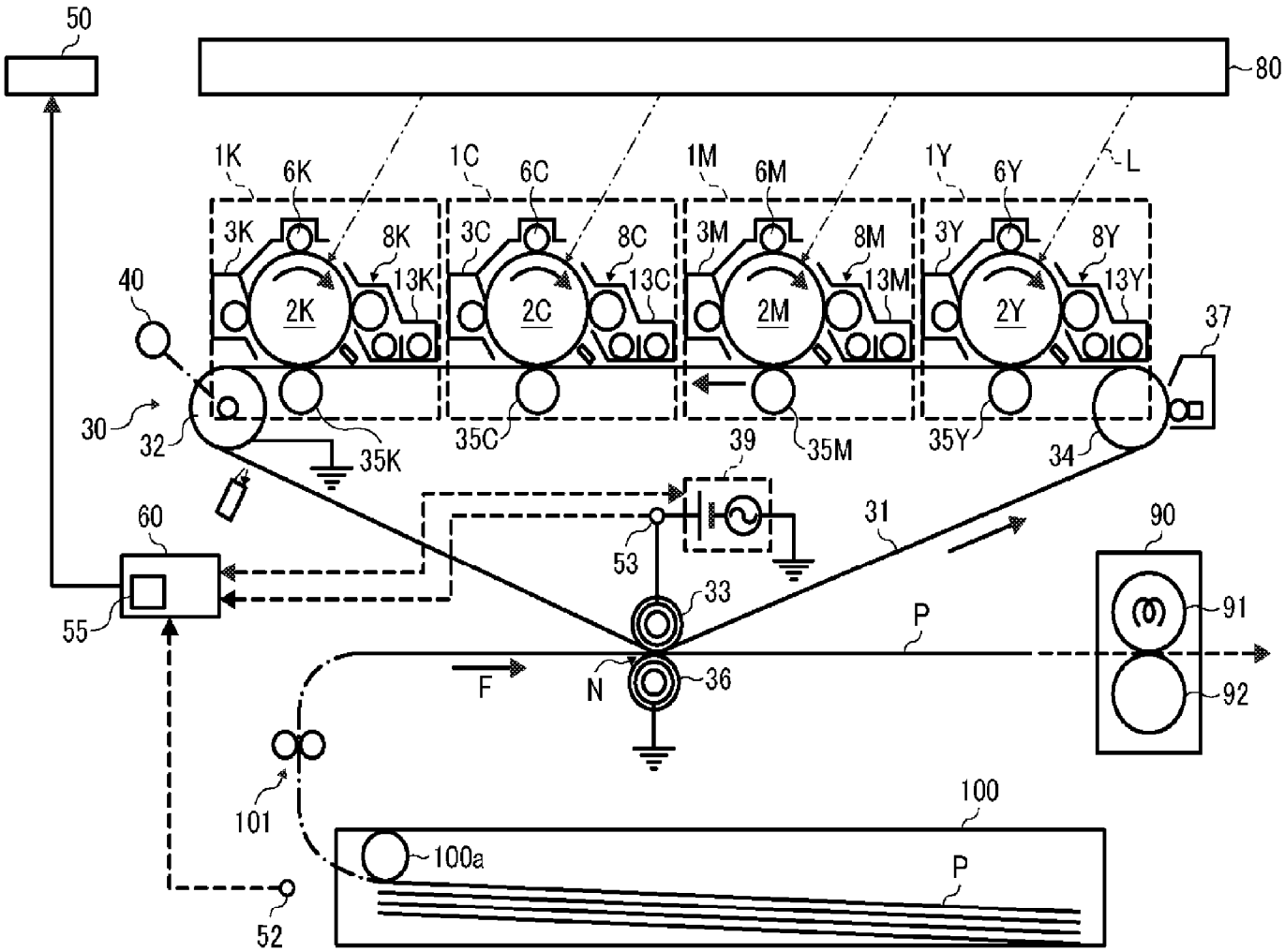
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an electrophotographic color printer as an example of an image forming apparatus according to an illustrative embodiment of the present invention. FIG. 1 is a schematic diagram illustrating a printer as an example of an image forming apparatus of the present disclosure. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a paper cassette 100, a pair of registration rollers 101, and a controller 60.

It is to be noted that the suffixes Y, M, C, and K denote colors yellow, magenta, cyan, and black, respectively. To simplify the description, these suffixes Y, M, C, and K indicating colors are omitted herein, unless otherwise specified.

The image forming units 1Y, 1M, 1C, and 1K all have the same configuration as all the others, differing only in the color of toner employed. Thus, a description is provided of the image forming unit 1K for forming a toner image of black as a representative example of the image forming units. The image forming units 1Y, 1M, 1C, and 1K are replaced upon reaching their product life cycles.

Figure 2:
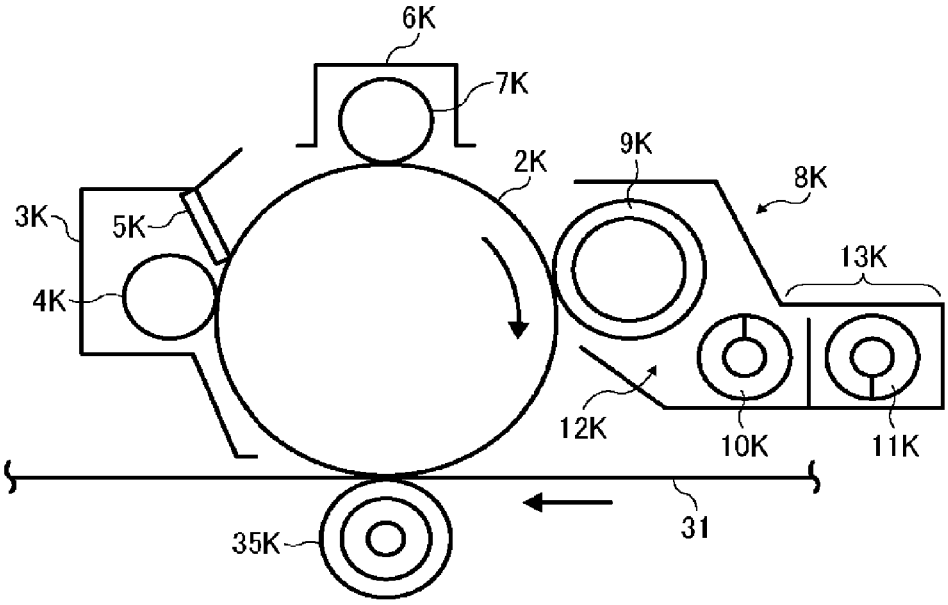
FIG. 2 is a schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. As illustrated in FIG. 2, the image forming unit 1K for forming a black toner image includes a drum-shaped photoconductor 2K (hereinafter referred to as photoconductor) serving as a latent image bearer, a charging device 6K, a developing device 8K, a drum cleaning device 3K, and so forth. These devices are held in a common casing so that they are detachably installable and replaced at the same time. Similar to the image forming unit 1K, the image forming units 1Y, 1M, and 1C include photoconductors 2Y, 2M, and 2C, respectively. The photoconductors 2Y, 2M, and 2C are surrounded by charging devices 6Y, 6M, and 6C, developing devices 8Y, 8M, and 8C, drum cleaning devices 3Y, 3M, and 3C, respectively.

The photoconductor 2K is comprised of a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or approaches the photoconductor 2K to generate electrical discharge therebetween, thereby charging uniformly the surface of the photoconductor 2K. According to the present illustrative embodiment, the photoconductor 2K is uniformly charged with a negative polarity which is the same polarity as the normal charge polarity of the toner. More specifically, the photoconductor 2K is charged uniformly at approximately −650 V.

According to the present illustrative embodiment, an alternating current (AC) voltage superimposed on a direct current (DC) voltage is employed as a charging bias. The charging roller 7K comprises a metal cored bar coated with a conductive elastic layer made of a conductive elastic material. According to the present illustrative embodiment, the photoconductor 2K is charged by a charger, i.e., the charging roller 7K contacting the photoconductor 2K or disposed near the photoconductor 2K. Alternatively, a corona charger may be employed.

The uniformly charged surface of the photoconductor 2K is scanned by a light beam projected from the optical writing unit 80, thereby forming an electrostatic latent image for black on the surface of the photoconductor 2K. The potential of the electrostatic latent image for black is approximately −100 V. The electrostatic latent image for black on the photoconductor 2K is developed with black toner by the developing device 8K. Accordingly, a visible image, also known as a toner image of black, is formed on the photoconductor 2K. As will be described later in detail, the toner image is transferred primarily onto a belt-type image bearer, i.e., an intermediate transfer belt 31.

The drum cleaning device 3K removes residual toner remaining on the photoconductor 2K after a primary transfer process, that is, after the photoconductor 2K passes through a primary transfer nip between the intermediate transfer belt 31 and the photoconductor 2K. The drum cleaning device 3K includes a brush roller 4K which is rotated and a cleaning blade 5K. The cleaning blade 5K is cantilevered, that is, one end thereof is fixed to the housing of the drum cleaning device 3K, and its free end contacts the surface of the photoconductor 2K. The brush roller 4K rotates and brushes off the residual toner from the surface of the photoconductor 2K while the cleaning blade 5K removes the residual toner by scraping.

It is to be noted that the cantilevered side of the cleaning blade 5K is positioned downstream from its free end contacting the photoconductor 2K in the direction of rotation of the photoconductor 2K so that the free end of the cleaning blade 5K faces or becomes counter to the direction of rotation.

The charge neutralizer removes residual charge remaining on the photoconductor 2K after the surface thereof is cleaned by the drum cleaning device 3K in preparation for the subsequent imaging cycle. The surface of the photoconductor 2K is initialized in preparation for the subsequent imaging cycle.

The developing device 8K includes a developing portion 12K and a developer conveyer 13K. The developing portion 12K includes a developing roller 9K inside thereof. The developer conveyer 13K mixes a developing agent for black and transports the developing agent. The developer conveyer 13K includes a first chamber equipped with a first screw 10K and a second chamber equipped with a second screw 11K. Each of the first screw 10K and the second screw 11K is constituted of a rotatable shaft and helical flighting wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical fighting and carries the developing agent from the distal end to the proximal end of the screw in the direction perpendicular to the surface of the recording medium while rotating. The first screw 10K is disposed parallel to and facing the developing roller 9K. The developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is transported from the proximal end to the distal end while being mixed in the direction of rotation.

In the second chamber, a toner density detector for detecting the density of toner in the developing agent is disposed at the bottom of a casing of the chamber. As the toner density detector, a magnetic permeability detector is employed. Because there is a correlation between the magnetic permeability of the two-component developing agent consisting of toner particles and magnetic carriers and the toner density of the black toner, the magnetic permeability detector is detecting the density of the toner.

Although not illustrated, the image forming apparatus includes toner supply devices to supply independently toner of yellow, magenta, cyan, and black to the second chamber of the respective developing device. The controller 60 of the image forming apparatus includes a Random Access Memory (RAM) to store a target output voltage Vtref for each output voltage provided by the toner density detectors for yellow, magenta, cyan, and black. If the difference between each output voltage provided by the toner detectors and the target value Vtref for each color exceeds a predetermined value, the toner supply devices are activated. Accordingly, the respective color of toner is supplied to the second chamber of the developing device.

The developing roller 9K in the developing portion 12K faces the first screw 10K as well as the photoconductor 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 10K is borne on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as toner. The developing bias is greater than the bias of the electrostatic latent image on the photoconductor 2K, but less than the charging potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A non-developing potential acts between the developing sleeve and the non-image formation areas of the photoconductor 2K, causing the toner on the developing sleeve to move to the sleeve surface. Due to the developing potential and the non-developing potential, the toner on the developing sleeve moves selectively to the electrostatic latent image formed on the photoconductor 2K, thereby forming a visible image, known as a toner image.

In FIG. 1, similar to the image forming unit 1K, in the image forming units 1Y, 1M, and 1C, toner images of yellow, magenta, and cyan are formed on the photoconductors 2Y, 2M, and 2C, respectively.

The optical writing unit 80 for writing a latent image on the photoconductors 2Y, 2M, 2C, and 2K is disposed above the image forming units 1Y, 1M, 1C, and 1K. Based on image information provided by external devices such as a personal computer (PC), the optical writing unit 80 illuminates the photoconductors 2Y, 2M, 2C, and 2K with a light beam projected from a light source, for example, a laser diode of the optical writing unit 80. Accordingly, electrostatic latent images of yellow, magenta, cyan, and black are formed on the photoconductors 2Y, 2M, 2C, and 2K, respectively. More specifically, the potential of the portion of the charged surface of the photoconductor 2 illuminated with the light beam is attenuated.

The potential of the illuminated portion of the photoconductor 2 with the light beam is less than the potential of the other area, that is, a background portion (non-image formation area), thereby forming an electrostatic latent image on the surface of the photoconductor 2. The optical writing unit 80 includes a polygon mirror, a plurality of optical lenses, and mirrors. The light beam projected from the laser diode serving as a light source is deflected in a main-scanning direction by the polygon mirror rotated by a polygon motor. The deflected light, then, illuminates the optical lenses and mirrors, thereby scanning each photoconductor. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 as an image bearing member formed into an endless loop and entrained about a plurality of rollers, thereby being moved endlessly in the counterclockwise direction indicated by arrow A. The transfer unit 30 also includes a drive roller 32, an opposed roller 33, a cleaning backup roller 34, a nip forming roller 36, a belt cleaning device 37, four primary transfer rollers 35Y, 35M, 35C, and 35K as transfer devices, and so forth.

The intermediate transfer belt 31 is entrained around and stretched taut between the drive roller 32, the opposed roller 33, the cleaning backup roller 34, and the primary transfer rollers 35Y, 35M, 35C, and 35K (which may be collectively referred to as the primary transfer rollers 35, unless otherwise specified). The drive roller 32, the opposed roller 33, the cleaning backup roller 34, and the primary transfer rollers 35Y, 35M, 35C, and 35K are disposed inside the loop formed by the intermediate transfer belt 31. According to the present illustrative embodiment, the drive roller 32 is rotated in the counterclockwise direction by a driving device 40 such as a motor, and rotation of the drive roller 32 enables the intermediate transfer belt 31 to rotate in the counterclockwise direction in FIG. 1.

The intermediate transfer belt 31 is interposed between the primary transfer rollers 35Y, 35M, 35C, and 35K, and the photoconductors 2Y, 2M, 2C, and 2K. Accordingly, primary transfer nips are formed between the front surface (image bearing surface) of the intermediate transfer belt 31 and the photoconductors 2Y, 2M, 2C, and 2K. A primary transfer bias is applied to the primary transfer rollers 35Y, 35M, 35C, and 35K by a primary transfer bias power source. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The toner image for yellow formed on the photoconductor 2Y enters the primary transfer nip as the photoconductor 2Y rotates. Subsequently, the toner image is transferred primarily from the photoconductor 2Y to the intermediate transfer belt 31 by the transfer electric field and the nip pressure. This process is known as the primary transfer. Then, the intermediate transfer belt 31, on which the toner image of yellow has been transferred, passes through the primary transfer nips of magenta, cyan, and black, accordingly.

The toner images on the photoconductors 2M, 2C, and 2K are superimposed on the yellow toner image which has been transferred on the intermediate transfer belt 31, thereby forming a composite toner image on the intermediate transfer belt 31 in the primary transfer process. Accordingly, a composite toner image, in which the toner images of yellow, magenta, cyan, and black are superimposed on one another, is formed on the surface of the intermediate transfer belt 31.

Each of the primary transfer rollers 35Y, 35M, 35C, and 35K is constituted of an elastic roller including a metal cored bar on which a conductive sponge layer is fixated. The shaft center of each of the shafts of the primary transfer rollers 35Y, 35M, 35C, and 35K is approximately 2.5 mm off from the shaft center of the shafts of the photoconductors 2Y, 2M, 2C, and 2K toward the downstream side in the traveling direction of the intermediate transfer belt 31. According to the present illustrative embodiment, a primary transfer bias under constant current control is applied to the primary transfer rollers 35Y, 35M, 35C, and 35K described above is supplied with. According to the present illustrative embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The nip forming roller 36 of the transfer unit 30 is disposed outside the loop formed by the intermediate transfer belt 31, opposite the opposed roller 33. The intermediate transfer belt 31 is interposed between the nip forming roller 36 and the opposed roller 33, thereby forming a secondary transfer nip N at which the front surface or the image bearing surface of intermediate transfer belt 31 contacts the surface of the nip forming roller 36. In the example shown in FIGS. 1 and 2, the nip forming roller 36 is grounded. A power source 39 for the secondary transfer bias applies the secondary transfer bias to the opposed roller 33 disposed inside the looped belt. With this configuration, a secondary transfer electric field is formed between the opposed roller 33 and the nip forming roller 36 so that the toner having negative polarity is transferred electrostatically from the opposed roller 33 side to the nip forming roller 36 side.

As illustrated in FIG. 1, the paper cassette 100 storing a bundle of recording media P is disposed substantially below the transfer unit 30. The paper cassette 100 is equipped with a feed roller 100*a* that contacts a top sheet of the bundle of recording media P. As the feed roller 100*a* is rotated at a predetermined speed, the feed roller 100*a* picks up the top sheet and feeds it to a paper feed path in the image forming apparatus.

Substantially at the end of the paper feed path, the pair of registration rollers 101 is disposed. The pair of registration rollers 101 stops rotating temporarily, immediately after the recording medium P delivered from the paper cassette 100 is interposed between the registration rollers 101. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N. In the secondary transfer nip N, the recording medium P tightly contacts the composite toner image on the intermediate transfer belt 31, and the composite toner image is transferred onto the recording medium P by the secondary transfer electric field and the nip pressure applied thereto. The recording medium P, on which the composite color toner image is formed, passes through the secondary transfer nip N and separates from the nip forming roller 36 and the intermediate transfer belt 31 due to the curvature.

The opposed roller 33 includes a cored bar on which a conductive nitrile rubber (NBR) layer is disposed. The nip forming roller 36 includes a cored bar on which the conductive NBR rubber layer is disposed.

The power source 39 outputs a voltage (i.e., secondary transfer bias) to transfer the toner image from the intermediate transfer belt 31 onto the recording medium P interposed in the secondary transfer nip N. The power source 39 includes a direct current (DC) power source and an alternating current (AC) power source, and can output a superimposed bias as the secondary transfer bias in which an AC voltage is superimposed on a DC voltage. According to the present illustrative embodiment as shown in FIG. 1, the nip forming roller 36 is grounded while the secondary transfer bias is applied to the opposed roller 33.

Figure 3:
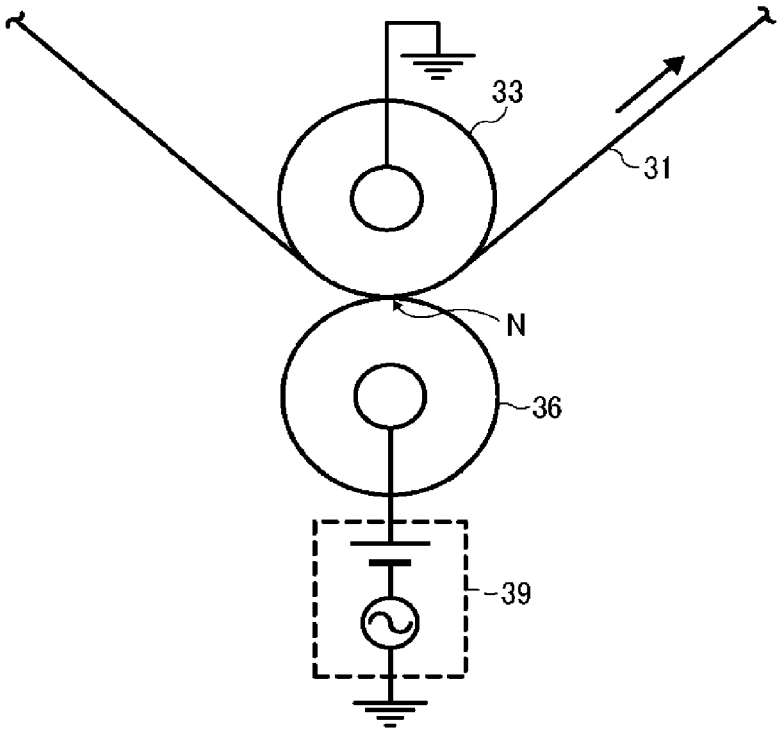
FIG. 3 is a schematic diagram illustrating a power source for secondary transfer employed in the image forming apparatus of FIG. 1.

Application of the secondary transfer bias is not limited to the embodiment shown in FIG. 1. Alternatively, as illustrated in FIG. 3, the opposed roller 33 is grounded while the superimposed bias from the power source 39 is applied to the nip forming roller 36. In this case, the polarity of the DC voltage is changed. More specifically, as illustrated in FIG. 1, when the superimposed bias is applied to the opposed roller 33 while the toner has a negative polarity and the nip forming roller 36 is grounded, the DC voltage of the same negative polarity as the toner is used so that a time-averaged potential of the superimposed bias is of the same negative polarity as the toner.

By contrast, as illustrated in FIG. 3, in a case in which the opposed roller 33 is grounded and the superimposed bias is applied to the nip forming roller 36, the DC voltage of a positive polarity opposite to the polarity of toner is used so that the time-averaged potential of the superimposed bias has the positive polarity opposite to the polarity of toner.

Figure 4:
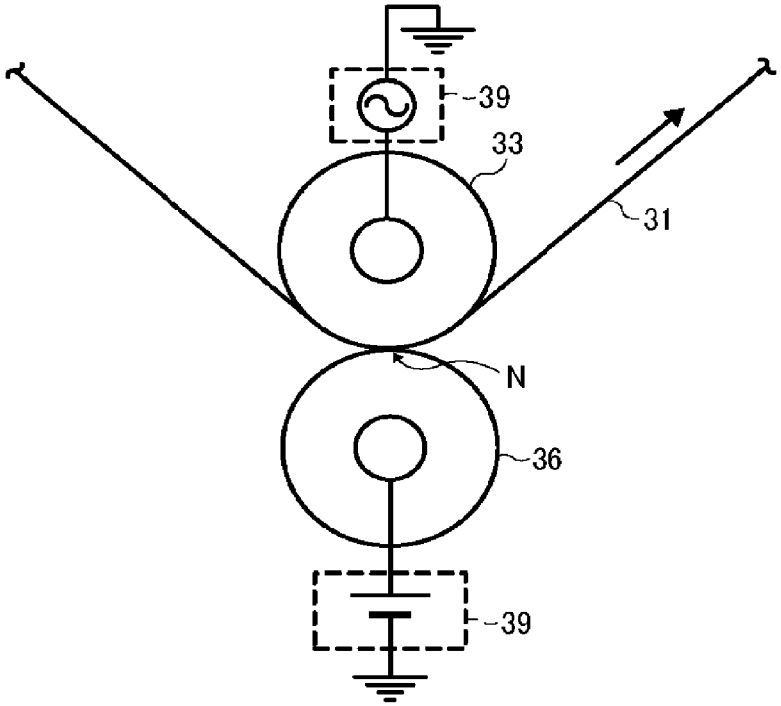
FIG. 4 is a schematic diagram illustrating a variation of the power source for the secondary transfer.
Figure 5:
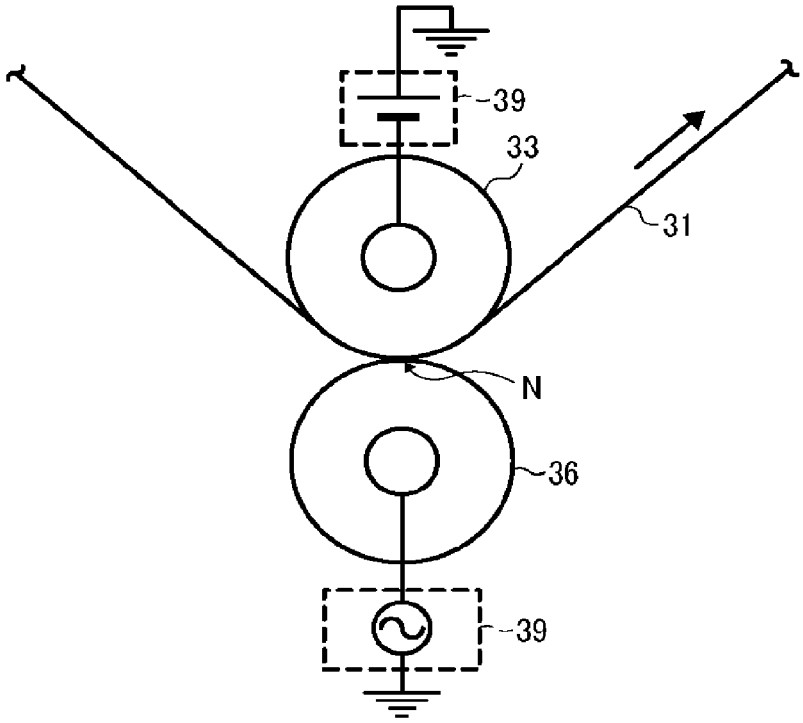
FIG. 5 is a schematic diagram illustrating another variation of the power source for the secondary transfer.

Alternatively, as illustrated in FIGS. 4 and 5, the DC voltage is supplied from one of power sources 39 independently disposed to one of the opposed roller 33 and the nip forming roller 36 while the other power source 39 supplies the AC voltage to the other roller, instead of supplying the superimposed bias to one of the opposed roller 33 and the nip forming roller 36.

Figure 6:
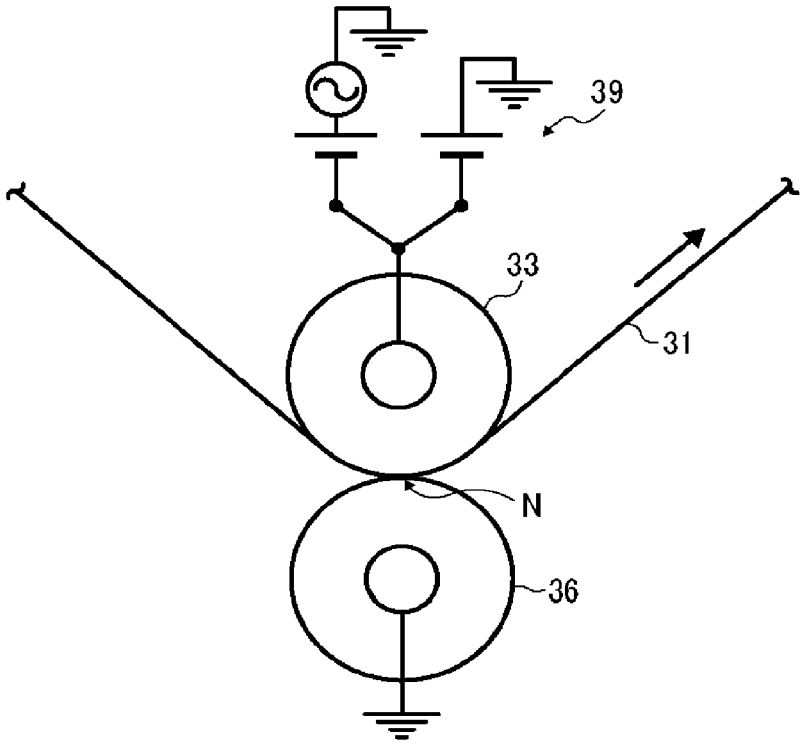
FIG. 6 is a schematic diagram illustrating another variation of the power source for the secondary transfer.
Figure 7:
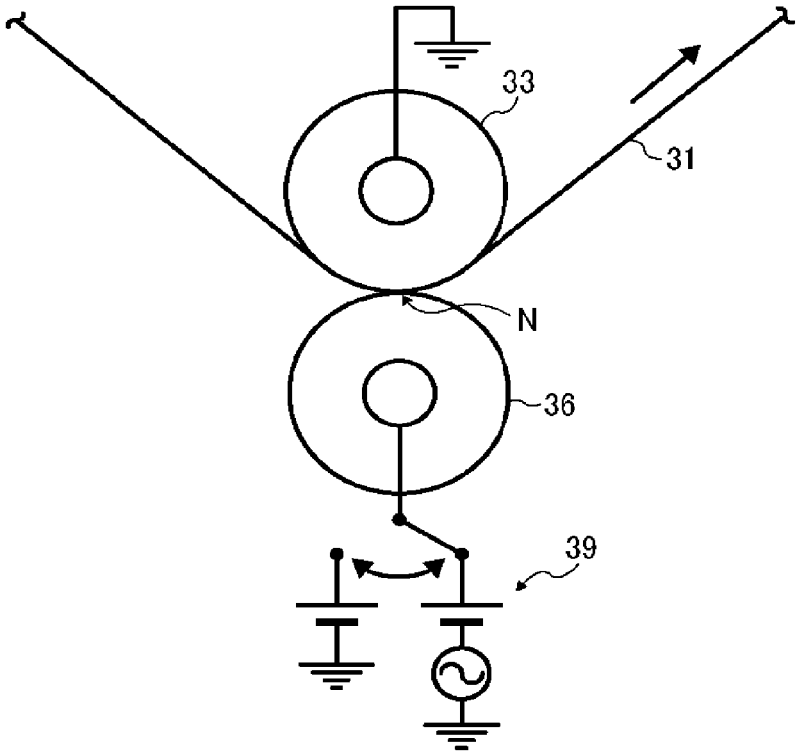
FIG. 7 is a schematic diagram illustrating another variation of the power source for the secondary transfer.

Application of the secondary transfer bias is not limited to the configurations described above. In some embodiments, as illustrated in FIGS. 6 and 7, the power source 39 can switch between a combination of the DC voltage and the AC voltage, and the DC voltage, and supply the voltage to one of the opposed roller 33 and the nip forming roller 36. More specifically, in FIG. 6, the power source 39 switches the voltage between the combination of the DC voltage and the AC voltage, and the DC voltage, and supplies the voltage to the opposed roller 33. In FIG. 7, the power source 39 switches the voltage between the combination of the DC voltage and the AC voltage, and the DC voltage, and supplies the voltage to the nip forming roller 36.

Figure 8:
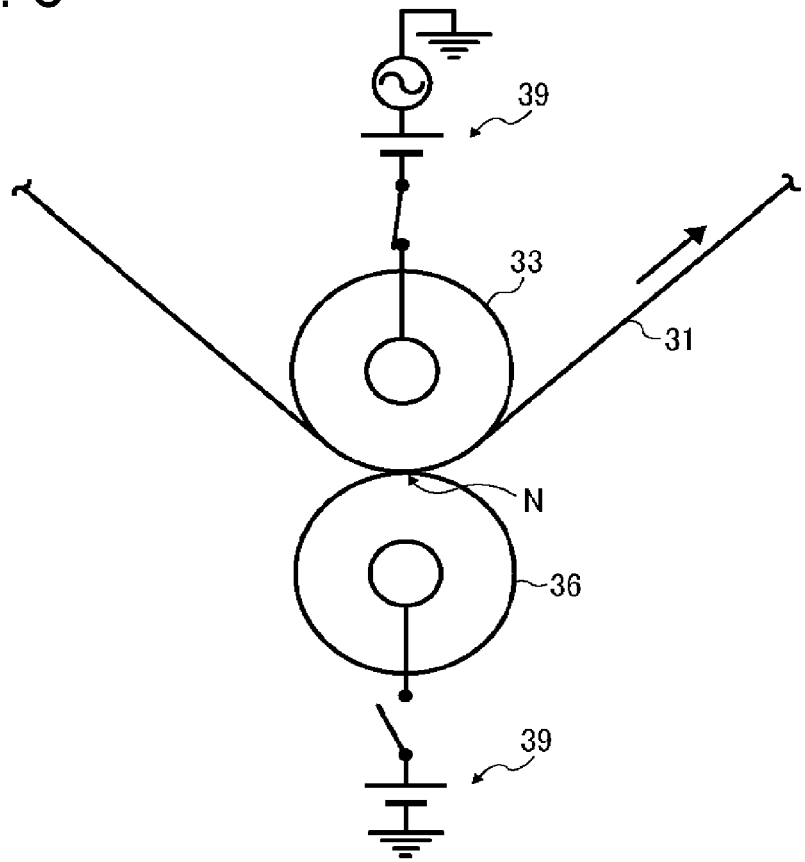
FIG. 8 is a schematic diagram illustrating another variation of the power source for the secondary transfer.
Figure 9:
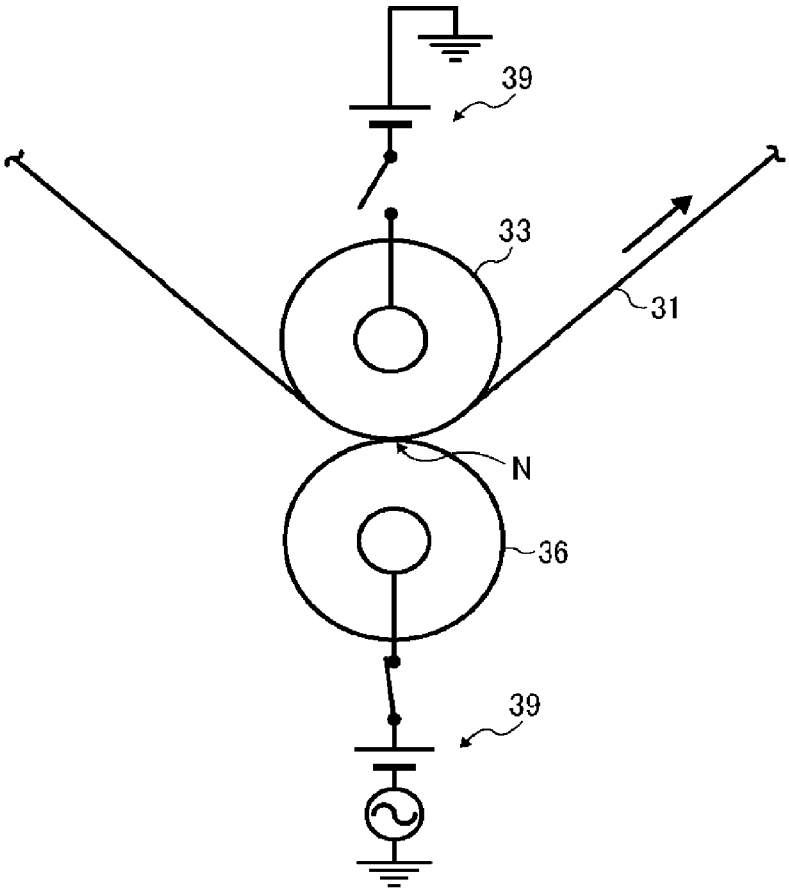
FIG. 9 is a schematic diagram illustrating another variation of the power source for the secondary transfer.

Still alternatively, in a case in which the voltage is switched between the combination of the DC voltage and the AC voltage, and the DC voltage, as illustrated in FIGS. 8 and 9, multiple power sources 39 are provided to independently supply voltages to the opposed roller 33 and the nip forming roller 36. More specifically, one of the power sources 39 supplies the combination of the DC voltage and the AC voltage to one of the opposed roller 33 and the nip forming roller 36 while the other power source 39 supplies the DC voltage to the other roller. In the illustrative embodiment illustrated in FIG. 8, the combination of the DC voltage and the AC voltage can be supplied to the opposed roller 33, and the DC voltage can be supplied to the nip forming roller 36. In the illustrative embodiment illustrated in FIG. 9, the DC voltage can be supplied to the opposed roller 33, and the combination of the DC voltage and the AC voltage can be supplied to the nip forming roller 36.

As described above, there is a variety of ways in which the secondary transfer bias is applied to the secondary transfer nip N. Thus, a suitable power source may be selected. For example, in some embodiments, a power source, such as the power source 39 capable of supplying the combination of the DC voltage and the AC voltage is employed. In some embodiments, a power source capable of supplying independently the DC voltage and the AC voltage is employed. Still alternatively, a single power source capable of switching application of the bias between the combination of the DC voltage and the AC voltage, and the DC voltage may be employed.

The power source 39 for the secondary transfer bias includes a first mode in which the power source 39 outputs only the DC voltage and a second mode in which the power source 39 outputs a superimposed voltage including the AC voltage superimposed on the DC voltage. The first mode and the second mode are switchable. According to the illustrative embodiments shown in FIG. 1 and FIGS. 3 through 5, the first mode and the second mode can be switched by turning on and off the output of the AC voltage. According to the illustrative embodiments shown in FIGS. 6 through 9, a plurality of power sources (for example, two power sources) is employed and switched selectively by a switching device such as a relay. By switching selectively between the two power sources, the first mode and the second mode can be selectively switched.

When using a regular sheet of paper as a recording medium P, such as paper having a relatively smooth surface, a pattern of dark and light patches according to the surface conditions is less likely to appear on the recording medium P. In this case, the first mode is selected to supply the secondary transfer bias consisting only of the DC voltage. By contrast, when using a recording medium p such as coarse paper having a rough surface, the second mode is selected to supply a superimposed bias in which the AC voltage is superimposed on the DC voltage as a secondary transfer bias. In other words, in accordance with types (degree of surface roughness) of recording media P, the secondary transfer bias is switched between the first mode and the second mode.

After the intermediate transfer belt 31 passes through the secondary transfer nip N, toner residues not having been transferred onto the recording medium P remain on the intermediate transfer belt 31. The toner residues are removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37 from inside the loop of the intermediate transfer belt 31 so that the toner residues remaining on the intermediate transfer belt 31 are removed reliably.

The fixing device 90 is disposed on the right side in FIG. 1, that is, downstream from the secondary transfer nip N in the direction of conveyance of the recording medium P. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92. The surface of the recording medium P bearing the unfixed toner image tightly contacts the fixing roller 91. Under heat and pressure, toner adhered to the toner image is softened and fixed to the recording medium P in the fixing nip. Subsequently, the recording medium P is output outside the image forming apparatus from the fixing device 90 via the delivery path after fixing.

According to the present illustrative embodiment, the controller 60 can carry out different printing modes including, but not limited to, a normal mode, a high-quality mode, and a high-speed mode. In the normal mode, a process linear velocity, that is, a linear velocity of the photoconductor and the intermediate transfer belt, is approximately 280 mm/s. It is to be noted that the process linear velocity in the high quality mode in which priority is given to image quality over the printing speed is slower than that in the normal mode. On the contrary, the process linear velocity in the high-speed mode in which priority is given to the printing speed over the image quality is faster than that in the normal mode. Users can change the print modes between the normal mode, the high-quality mode, and the high-speed mode through a control panel 50 (illustrated in FIG. 16) of the image forming apparatus or a printer property menu in a personal computer.

In a case in which a monochrome image is formed, a movable support plate supporting the primary transfer rollers 35Y, 35M, and 35C of the transfer unit 30 is moved to separate the primary transfer rollers 35Y, 35M, and 35C from the photoconductors 2Y, 2M, and 2C. Accordingly, the front surface of the intermediate transfer belt 31, that is, the image bearing surface, is separated from the photoconductors 2Y, 2M, and 2C so that the intermediate transfer belt 31 contacts only the photoconductor 2K. In this state, only the image forming unit 1K is activated to form a toner image of black on the photoconductor 2K.

According to the present illustrative embodiment, the DC component of the secondary transfer bias has the same value as the time-averaged value Vave of the voltage of the DC component. The time-averaged value Vave of the voltage is obtained by dividing an integral value of a voltage waveform by the length of one cycle.

In the image forming apparatus of the illustrative embodiment in which the secondary transfer bias is applied to the opposed roller 33 and the nip forming roller 36 is grounded, if the polarity of the secondary transfer bias is negative so is the polarity of the toner, the toner having the negative polarity is forced electrostatically from the opposed roller 33 side to the nip forming roller 36 side in the secondary transfer nip N. Accordingly, the toner on the intermediate transfer belt 31 is transferred onto the recording medium P. By contrast, if the polarity of the superimposed bias has a polarity opposite that of the toner, that is, the polarity of the superimposed bias is positive, the toner having the negative polarity is attracted electrostatically to the opposed roller 33 side from the nip forming roller 36 side. Consequently, the toner transferred to the recording medium P is attracted again to the intermediate transfer belt 31 side.

When using a recording medium P having a coarse surface such as Japanese paper, a pattern of light and dark according to the surface condition of the recording medium P appears easily in an output image. To address such a difficulty, in one approach, not only a DC voltage, but also a DC voltage superimposed on an AC voltage is applied as a secondary transfer bias, thereby preventing the pattern of light and dark, as compared with supplying only the DC voltage.

However, when applying the superimposed bias consisting of a DC voltage superimposed on an AC voltage as the transfer bias, depending on a waveform of the AC voltage, a polarity may be switched before reaching a difference (Vpp) between a maximum voltage and a minimum voltage employed for transfer, thereby complicating efforts to obtain the target difference (Vpp). In view of the above, the difference Vpp may be increased. However, simply increasing the difference Vpp causes imaging failure such as electrical discharge or the like, and as a result, the image cannot be properly formed on the recording medium.

In view of the above, there is demand for an image forming apparatus capable of forming a high-quality image on a recording medium even when the difference (Vpp) between the maximum and the minimum voltages of the transfer bias is increased.

Figure 10:
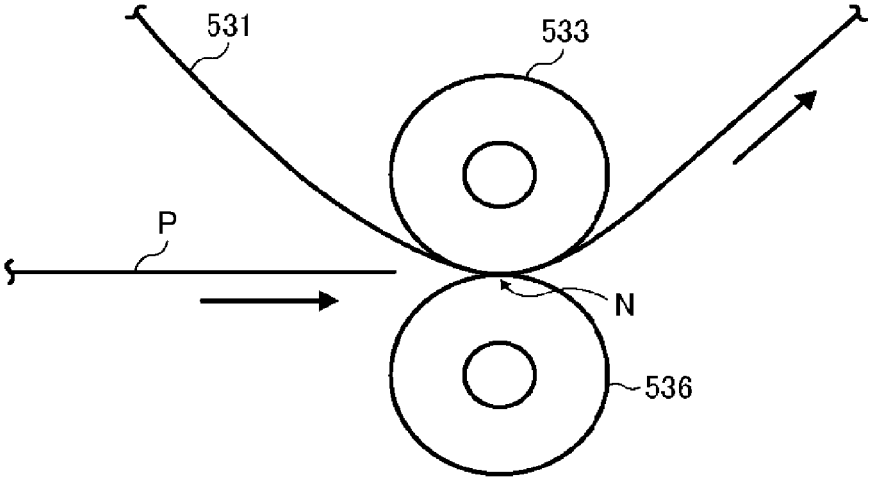
FIG. 10 is an enlarged diagram schematically illustrating an example of a secondary transfer nip.

Although advantageous and generally effective for its intended purpose, the toner is still not transferred well to the recessed portions of the surface of the recording medium P, resulting in image defects such as multiple white spots or dropouts in the image. With respect to such a transfer failure, the present inventor has recognized the following. FIG. 10 is a schematic diagram illustrating an example of a secondary transfer nip N at which a opposed roller 533 and a nip forming roller 536 meet and press against each other via an intermediate transfer belt 531. More specifically, the opposed roller 533 contacts the rear surface of the intermediate transfer belt 531 and presses the intermediate transfer belt 531 against the nip forming roller 536.

The secondary transfer nip N is formed between the peripheral surface or the image bearing surface of the intermediate transfer belt 531 and the nip forming roller 536 contacting the surface of the intermediate transfer belt 531. In the secondary transfer nip N, a toner image on the intermediate transfer belt 531 is transferred secondarily onto a recording medium P fed to the secondary transfer nip N.

The secondary bias for transferring secondarily the toner image onto the recording medium P is applied to one of the nip forming roller 536 and the opposed roller 533, and the other one of these rollers is grounded. The toner image can be transferred onto the recording medium P by applying the transfer bias to either the nip forming roller 536 or the opposed roller 533. Herein, a description is provided of application of the secondary transfer bias to the opposed roller 533 when using toner having a negative polarity. In this case, in order to move the toner in the secondary transfer nip N from the opposed roller 533 side to the nip forming roller 536 side, a superimposed bias is applied as the secondary transfer bias. More specifically, a time-averaged electrical potential of the secondary transfer bias has the same negative polarity as that of the toner.

Figure 11:
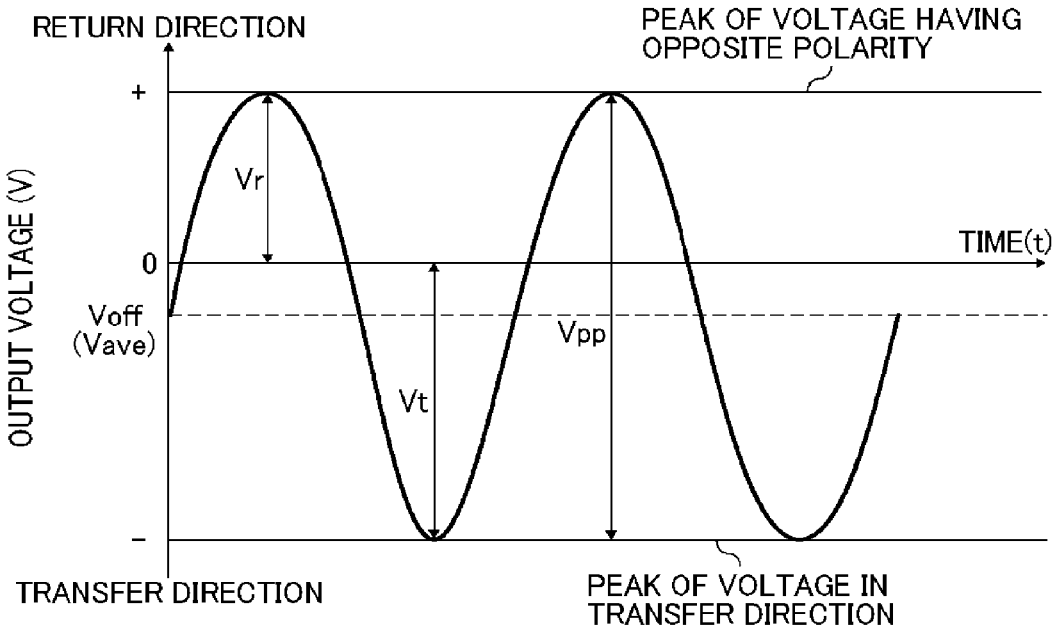
FIG. 11 is a waveform chart showing an example of a waveform of a voltage consisting of a superimposed bias.

With reference to FIG. 11, a description is provided of the secondary transfer bias including the superimposed bias applied to the opposed roller 533. FIG. 11 shows an example of a waveform of the superimposed bias, which is a sine wave. In FIG. 11, the time-averaged voltage (hereinafter referred to as time-averaged value) Vave [V] represents a time-averaged value of the secondary transfer bias. In the present illustrative embodiment shown in FIG. 11, the secondary transfer bias including the superimposed bias has a sine wave which has a peak (peak value of the voltage of the opposite polarity) at a return direction side and a peak (peak value of voltage) at a transfer direction side. In FIG. 11, a reference sign Vt refers to one of the two peak values, that is, the peak value at the transfer direction side for moving the toner from the belt side to the nip forming roller 536 side (referred to as the transfer direction side). Thereafter, this peak value is referred to as a transfer-direction peak value Vt. A reference sign Vr refers to the other peak value, that is, the peak value for returning the toner from the nip forming roller 536 side to the belt side (referred to as the return direction side). Thereafter, this peak value is referred to as a return peak value Vr.

Instead of applying the superimposed bias, even when an AC bias including only an AC component is applied, it is possible to move the toner back and forth between the intermediate transfer belt 531 and the recording medium P in the secondary transfer nip N. However, the AC bias simply causes the toner to move back and forth between the intermediate transfer belt 531 and the recording medium P, and it is difficult to transfer or settle the toner onto the recording medium P. If the superimposed bias including the DC component is applied to adjust the time-averaged voltage Vave [V], that is, the time-averaged value of the superimposed bias, to the same negative polarity as the toner, it is possible to move the toner relatively from the belt side toward the recording medium P while the toner moves back and forth between the belt side and the recording medium side. Ultimately, the toner can be transferred onto the recording medium P.

The present inventor has recognized in the observation of toner movement that hen application of the secondary transfer bias including the superimposed bias is initiated, only a very small number of toner particles on the surface of a toner layer on the intermediate transfer belt 531 first separates from the toner layer and moves toward recessed portions of the surface of the recording medium P. However, most of the toner particles in the toner layer remain therein. The very small number of toner particles separated from the toner layer enters the recessed portions of the surface of the recording medium P. Subsequently, if the direction of the electric field is reversed, the toner particles return from the recessed portions to the toner layer. When this happens, the toner particles returning to the toner layer strike the toner particles remaining in the toner layer so that adhesion of the toner particles to the toner layer (or to the recording medium P) is weakened. As a result, when the direction of the electric field reverses towards the direction of the recording medium P, more toner particles than in the initial time separate from the toner layer and move to the recessed portions of the recording medium P.

As this process is repeated, the amount of toner particles separating from the toner layer and entering the recessed portions of the recording medium P is increased gradually. Consequently, a sufficient amount of toner particles is transferred to the recessed portions of the recording medium P.

In this configuration, however, the level of the return peak value Vr needs to be relatively high. Otherwise, the toner particles once entered in the recessed portions of the recording medium surface cannot be returned adequately to the toner layer on the intermediate transfer belt, resulting in a deficiency in image density at the recessed portions. Furthermore, the level of the time-averaged value Vave [V] of the secondary transfer bias needs to be relatively high. Otherwise, an amount of toner transferred onto projecting portions of the recording medium P is insufficient, resulting also in a deficiency in image density at the projecting portions. In order to obtain sufficient image density both at the projecting and recessed portions of the recording medium surface, the time-averaged value Vave [V] and the return peak value Vr need to be relatively large. To obtain a relatively large time-averaged value Vave [V] and a relatively large return peak value Vr, a peak-to-peak voltage Vpp needs to be set relatively high.

Here, the peak-to-peak voltage Vpp refers to a voltage from the return peak value Vr to the transfer-direction peak value Vt, which is a width between the highest and the lowest voltage. In other words, the peak-to-peak voltage Vpp is a difference between the maximum voltage and the minimum voltage employed for transfer. Accordingly, the transfer-direction peak value Vt is also relatively high. The transfer-direction peak value Vt corresponds to the maximum potential difference between the nip forming roller 536 being grounded and the opposed roller 533 to which the secondary transfer bias is applied. Hence, when the transfer-direction peak value Vt becomes high, electrical discharge tends to occur easily between the rollers. More specifically, electrical discharge occurs between a slight gap between the intermediate transfer belt and the recessed portions of the recording medium surface, causing dropouts or white spots in the image formed on the recessed portions of the recording medium surface more easily. It is known that image defects such as dropouts and white spots tend to occur easily in the image on the recessed portions of the recording medium surface because the peak-to-peak voltage Vpp is relatively high to obtain sufficient image density both at the projecting portions and the recessed portions of the recording medium surface.

Figure 12:
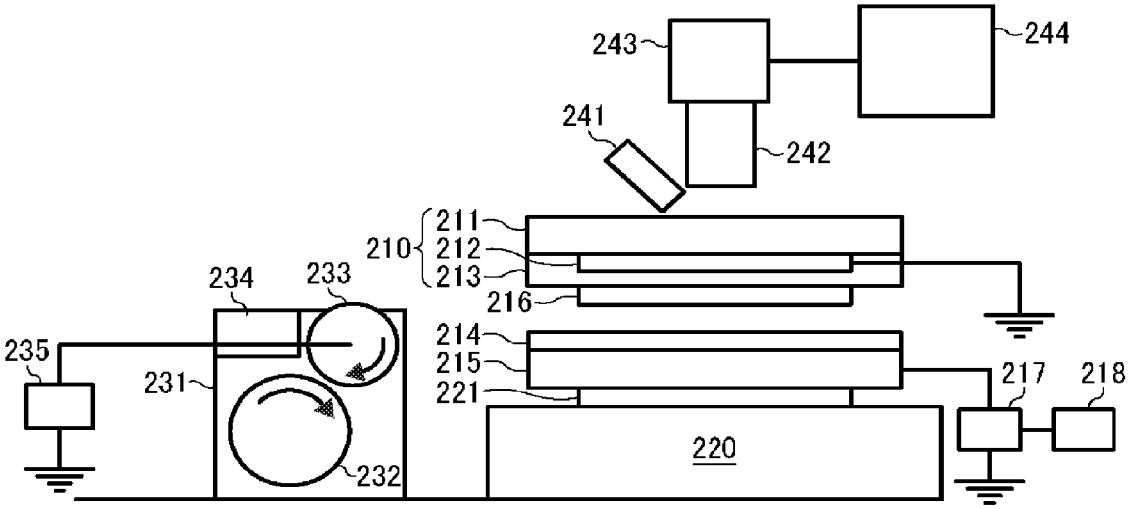
FIG. 12 is a schematic diagram illustrating an observation equipment for observation of behavior of toner in the secondary transfer nip.

Next, with reference to FIG. 12, a description is provided of transfer experiments performed by the present inventors.

The present inventors performed observation experiments using special observation equipment shown in FIG. 12. FIG. 12 is a schematic diagram illustrating the observation equipment for observation of behavior of toner in the secondary transfer nip N. The observation equipment includes a transparent substrate 210, a metal plate 215, a substrate 221, a developing device 231, a power source 235, a Z stage 220, a light source 241, a microscope 242, a high-speed camera 243, a personal computer 244, a voltage amplifier 217, a waveform generator 218, and so forth. The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212. The transparent substrate 210 is supported at a predetermined height by a substrate support. The substrate support is allowed to move in the vertical and horizontal directions in FIG. 12 by a moving assembly. In the illustrated example shown in FIG. 12, the transparent substrate 210 is located above the metal plate 215 placed on the Z stage 220. In accordance with the movement of the substrate support, the transparent substrate 210 can be moved to a position directly above the developing device 231 disposed lateral to the Z stage 220. The transparent electrode 212 of the transparent substrate 210 is connected to a grounded electrode fixed to the substrate support.

The developing device 231 has a similar configuration to the developing device 8K illustrated in FIG. 2 of the illustrative embodiment, and includes a screw 232, a developing roller 233, a doctor blade 234, and so forth. The developing roller 233 is rotated with a development bias applied thereto by the power source 235.

In accordance with the movement of the substrate support, the transparent substrate 210 is moved at a predetermined speed to a position directly above the developing device 231 and disposed opposite to the developing roller 233 with a predetermined gap therebetween. Then, toner on the developing roller 233 is transferred onto the transparent electrode 212 of the transparent substrate 210. Thereby, a toner layer 216 having a predetermined thickness is formed on the transparent electrode 212 of the transparent substrate 210. The toner adhesion amount per unit area relative to the toner layer 216 is adjustable by the toner density in the developing agent, the toner charge amount, the development bias value, the gap between the transparent substrate 210 and the developing roller 233, the moving speed of the transparent substrate 210, the rotation speed of the developing roller 233, and so forth.

The transparent substrate 210 formed with the toner layer 216 is translated to a position opposite a recording medium 214 adhered to the planar metal plate 215 by a conductive adhesive. The metal plate 215 is placed on the substrate 221 which is provided with a load sensor and placed on the Z stage 220. Further, the metal plate 215 is connected to the voltage amplifier 217. The waveform generator 218 provides the voltage amplifier 217 with a transfer bias including a DC voltage and an AC voltage. The transfer bias is amplified by the voltage amplifier 217 and applied to the metal plate 215. If the Z stage 220 is driven to elevate the metal plate 215, the recording medium 214 starts coming into contact with the toner layer 216. If the metal plate 215 is further elevated, the pressure applied to the toner layer 216 increases. The elevation of the metal plate 215 is stopped when the output from the load sensor reaches a predetermined value. With the pressure maintained at the predetermined value, a transfer bias is applied to the metal plate 215, and the behavior of the toner is observed. After the observation, the Z stage 220 is driven to lower the metal plate 215 and separate the recording medium 214 from the transparent substrate 210. Thereby, the toner layer 216 is transferred onto the recording medium 214.

The behavior of the toner is examined using the microscope 242 and the high-speed camera 243 disposed above the transparent substrate 210. The transparent substrate 210 is formed of multiple layers including the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner is observed was irradiated with light by the light source 241, and the focus of the microscope 242 was adjusted. Then, a transfer bias was applied to the metal plate 215 to move the toner in the toner layer 216 adhering to the lower surface of the transparent substrate 210 toward the recording medium 214. The behavior of the toner in this process was photographed by the high-speed camera 243.

The structure of the transfer nip in which toner is transferred onto a recording medium is different between the observation experiment equipment illustrated in FIG. 12 and the image forming apparatus of the illustrative embodiment. Therefore, the transfer electric field acting on the toner is different therebetween, even if the applied transfer bias is the same. To find appropriate observation conditions, transfer bias conditions allowing the observation experiment equipment to attain favorable density reproducibility on recessed portions of a surface of a recording medium were investigated. As the recording medium 214, a sheet of FC Japanese paper SAZANAMI manufactured by NBS Ricoh Company, Ltd. was used. As the toner, yellow (Y) toner having an average toner particle diameter of approximately 6.8 μm mixed with a relatively small amount of black (K) toner was used. The observation experiment equipment is configured to apply the transfer bias to the back surface of the recording medium 214 (i.e., SAZANAMI). Therefore, in the observation experiment equipment, the polarity of the transfer bias capable of transferring the toner onto the recording medium 214 is opposite to the polarity of the transfer bias employed in the image forming apparatus of the illustrative embodiment (i.e., positive polarity).

An AC component having a sinusoidal waveform was employed as the AC component of the secondary transfer bias including the superimposed bias. The frequency F of the AC component was set to approximately 1000 Hz. Further, the DC component (the time-averaged value Vave in the illustrative embodiment) was set to approximately 200 V, and the peak-to-peak voltage Vpp was set to approximately 1000 V. The toner layer 216 was transferred onto the recording medium 214 with a toner adhesion amount in a range of from approximately 0.4 mg/cm$^2$ to approximately 0.5 mg/cm$^2$. As a result, a sufficient image density was successfully obtained on the recessed portions of the surface of the recording medium, a SAZANAMI paper sheet.

Under the above-described conditions, the behavior of the toner was photographed with the microscope 242 focused on the toner layer 216 on the transparent substrate 210, and the following phenomenon was observed. The following behavior was observed. That is, the toner particles in the toner layer 216 moved back and forth between the transparent substrate 210 and the recording medium 214 due to an alternating electric field generated by the AC component of the transfer bias. With an increase in the number of the back-and-forth movements, the amount of toner particles moving back and forth increased.

Figure 13:
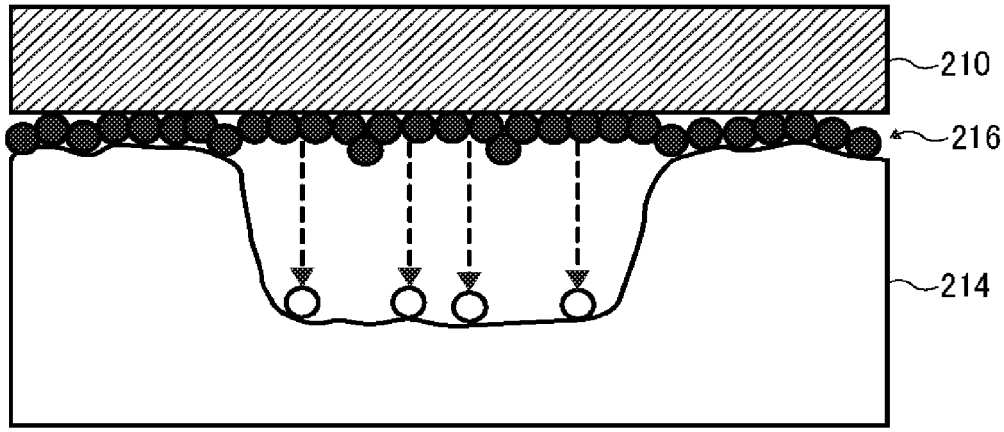
FIG. 13 is an enlarged schematic diagram illustrating behavior of toner in the secondary transfer nip at the beginning of transfer.
Figure 14:
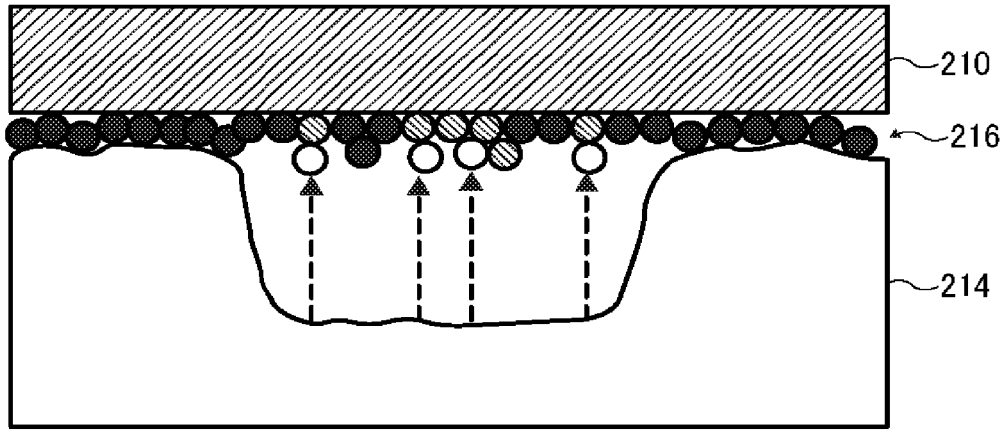
FIG. 14 is an enlarged schematic diagram illustrating behavior of the toner in the secondary transfer nip in the middle phase of transfer.

More specifically, in the transfer nip, there was one back-and-forth movement of toner particles in every cycle 1/f of the AC component of the secondary transfer bias due to a single action of the alternating electric field. In the first cycle, only toner particles present on a surface of the toner layer 216 separated from the toner layer 216, as illustrated in FIG. 13. The toner particles then entered the recessed portions of the recording medium 214, and subsequently returned again to the toner layer 216, as illustrated in FIG. 14. In this process, the returning toner particles collided with other toner particles remaining in the toner layer 216, thereby reducing the adhesion of the other toner particles to the toner layer 216 or to the transparent substrate 210.

In the next cycle, therefore, a larger amount of toner particles than in the previous cycle separated from the toner layer 216, as illustrated in FIG. 14. The toner particles then entered the recessed portions of the recording medium 214, and subsequently returned again to the toner layer 216, as illustrated in FIG. 14. In this process, the returning toner particles collided with other toner particles remaining in the toner layer 216, thereby reducing the adhesion of the other toner particles to the toner layer 216 or to the transparent substrate 210.

Figure 15:
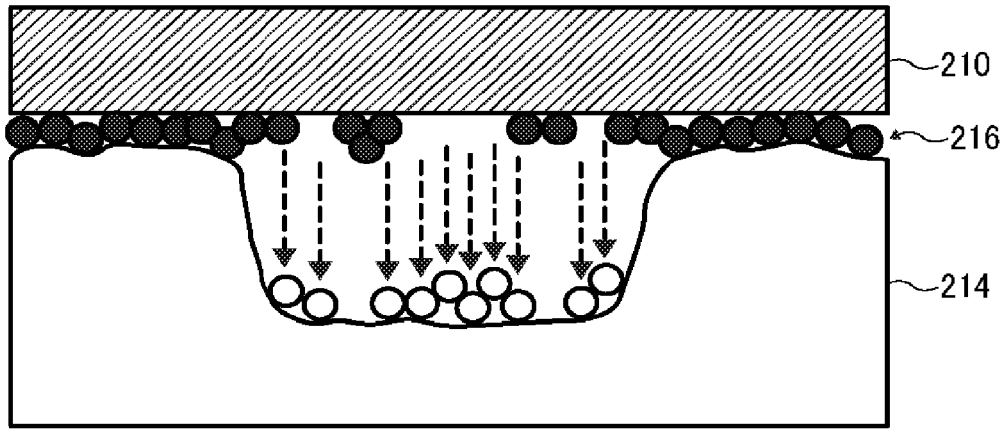
FIG. 15 is an enlarged schematic diagram illustrating behavior of toner in the secondary transfer nip in the last phase of transfer.

In the next cycle, therefore, a larger amount of toner particles than in the last cycle separated from the toner layer 216, as illustrated in FIG. 15. As described above, the number of toner particles moving back and forth was gradually increased in every back-and-forth movement. After the lapse of a nip passage time, that is, the time required for the toner to pass through the secondary transfer nip with the belt (in the observation experiment equipment, after the time corresponding to the actual nip passage time elapses), a sufficient amount of toner had been transferred to the recessed portions of the recording medium 214.

Further, the behavior of the toner was photographed under conditions with a DC voltage (i.e., the time-averaged value Vave in the illustrative embodiment) of approximately 200 V and the peak-to-peak voltage Vpp of approximately 800 V, and the following phenomenon was observed. It is to be noted that the peak-to-peak voltage Vpp is measured from a positive peak to a negative peak in one cycle, that is, the peak at the return direction side and the peak at the transfer direction side according to the illustrative embodiment. That is, some of the toner particles in the toner layer 216 present on the surface thereof separated from the toner layer 216 in the first cycle, and entered the recessed portions of the recording medium 214. Subsequently, however, the toner particles entered the recessed portions remained therein, without returning to the toner layer 216. In the next cycle, a very small number of toner particles newly separated from the toner layer 216 and entered the recessed portions of the recording medium 214. After the lapse of the nip passage time, therefore, only a relatively small amount of toner particles had been transferred to the recessed portions of the recording medium 214.

The present inventors conducted further experiments and found the following. That is, the return peak value Vr capable of causing the toner particles separated from the toner layer 216 and entered the recessed portions of the recording medium 214 to return to the toner layer 216 in the initial cycle depends on the toner adhesion amount per unit area on the transparent substrate 210. More specifically, the larger is the toner adhesion amount on the transparent substrate 210, the larger is the return peak value Vr capable of causing the toner particles in the recessed portions in the recording medium 214 to return to the toner layer 216.

Figure 16:
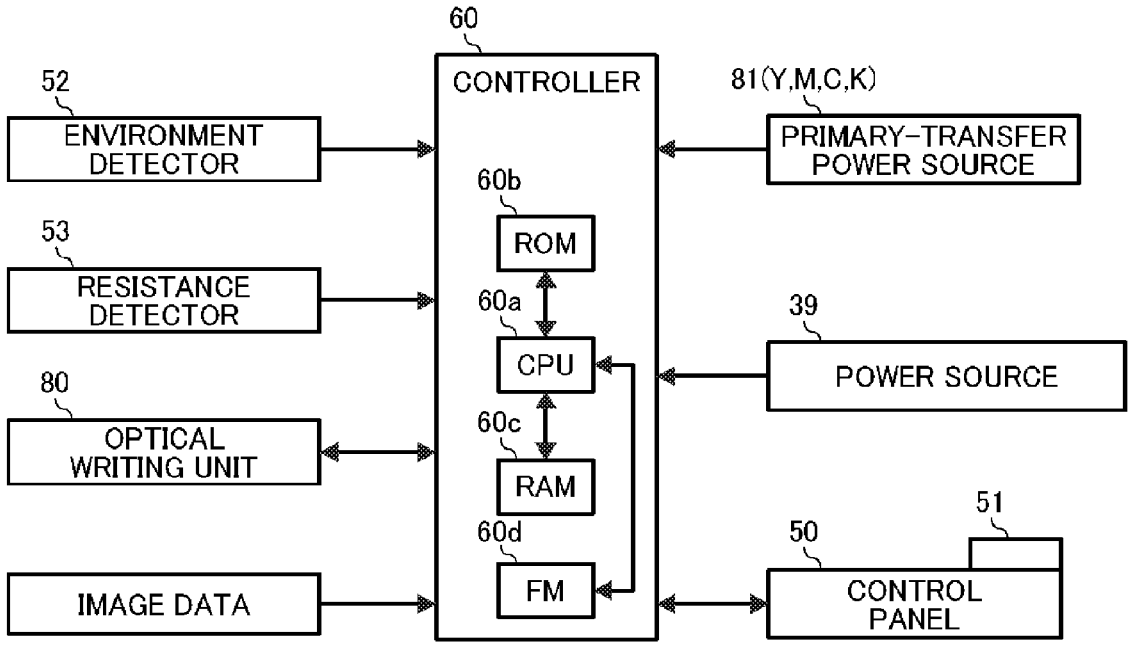
FIG. 16 is a block diagram illustrating an example of an electrical circuit of a control system of the image forming apparatus shown in FIG. 1.

With reference to FIG. 16, a description is provided of a characteristic configuration of the image forming apparatus according to an illustrative embodiment of the present disclosure.

FIG. 10 is a block diagram illustrating a control system of the image forming apparatus illustrated in FIG. 1. As illustrated in FIG. 16, the controller 60 constituting a part of the transfer bias generator includes a Central Processing Unit (CPU) 60*a* serving as a computing device, a Random Access Memory (RAM) 60*c* serving as a nonvolatile memory, a Read-Only Memory (ROM) 60*b* serving as a temporary storage device, a flash memory (FM) 60*d*, and so forth. The controller 60 for controlling the entire image forming apparatus is connected operatively to a variety of devices and sensors via signal lines. FIG. 16, however, illustrates only the devices associated with the characteristic configuration of the image forming apparatus of the illustrative embodiments of the present disclosure.

Primary transfer bias power sources 81 (Y, M, C, and K) output a primary transfer bias to be applied to the primary transfer rollers 35Y, 35M, 35C, and 35K. The power source 39 outputs a secondary transfer bias to be supplied to the secondary transfer nip N. According to the present illustrative embodiment, the power source 39 outputs the secondary transfer bias to be applied to the opposed roller 33. The power source 39 constitutes the transfer bias generator together with the controller 60. The control panel 50 includes a touch panel and a keypad. The control panel 50 displays an image on a screen of the touch panel, and receives an instruction entered by users using the touch panel and the keypad. The control panel 50 is capable of showing an image on the touch panel on the basis of a control signal transmitted from the controller 60.

The control panel 50 includes a selection device 51 for selecting a sheet type of the recording medium P. The selection device 51 selects arbitrarily the sheet type of the recording medium P to be used in the image forming apparatus and sends information of the recording medium P such as roughness of the surface of the recording medium P as input information to the controller 60. In some embodiments, the roughness of the recording medium P may be input to the controller 60 without using the selection device 51 by detecting the sheet type based on electrical resistance and reflectivity of known recording media, for example. Accordingly, the sheet type may be input as the surface roughness information to the controller 60.

An environment detector 52 for detecting at least one of operating temperature and humidity is connected to the controller 60 via a signal line. Here, the operating temperature and humidity refer to temperature and humidity in the image forming apparatus. Since resistance of the recording medium P and the intermediate transfer belt 31 changes depending on the temperature and humidity, the operating temperature or humidity may be the temperature or the humidity of the recording medium P and the intermediate transfer belt 31.

A resistance detector 53 for detecting electrical resistance of the transfer portion is connected to the controller 60 via a signal line. As illustrated in FIG. 1, the resistance detector 53 is disposed between the power source 39 and the opposed roller 33. The electrical resistance at the transfer portion herein refers to electrical resistance on an electrical path from the power source 39 and the nip forming roller 36. According to the present illustrative embodiment, the electrical resistance at the transfer portion is detected such that the nip forming roller 36 and the intermediate transfer belt 31 are in contact with each other without the recording medium P and a certain current, for example, −40 μA, is supplied thereto at the same speed as that during the printing operation. The voltage is then measured by the resistance detector 53. Accordingly, the electrical resistance of the transfer portion is detected. The controller 60 includes a waveform detector 55 (shown in FIG. 1) that detects a waveform of a voltage output from the power source 39 based on the electrical resistance.

In the image forming apparatus of FIG. 1, based on the output waveform detected by the waveform detector 55, the controller 60 controls the power source 39 such that a Duty expressed by B/(A+B) is increased with an increase in the difference between the maxim voltage and the minimum voltage (i.e., peak-to-peak voltage Vpp), and the Duty is decreased with a decrease in the difference between the maxim voltage and the minimum voltage (i.e., peak-to-peak voltage Vpp). That is, the power source 39 is controlled based on an actual output waveform output from the power source 39.

According to the present illustrative embodiment, the time-averaged value (Vave) of the voltage having the AC component in the secondary transfer bias is assumed to be closer to the transfer direction side relative to a midpoint voltage (midpoint value between the maximum voltage and the minimum voltage) Voff in the AC component. In order to obtain such a configuration, an area at the return direction side in the waveform needs to be smaller than an area at the transfer direction side relative to the midpoint voltage Voff of the AC component. The time-averaged value Vave of the voltage is obtained by dividing the integral value of the voltage waveform by the length of one cycle.

A description is provided of a waveform output from the power source 39 to obtain the above configuration.

In some embodiments, for the AC component, a slope of rising and falling of the voltage at the return direction side (toner returning from the recording medium side to the belt side) is less than that at a transfer direction side (toner transferring from the belt side to the recording medium). More specifically, the Duty (a return time ratio (%)) is defined as a ratio of time during which the voltage at the transfer direction side and the voltage at the opposite polarity side relative to the midpoint voltage value Voff are output in one cycle of the voltage waveform that alternately changes. The Duty is expressed by B/(A+B), where A is a time at the transfer direction side during which the voltage having a value closer to the transfer direction side relative to the midpoint voltage value is output, and B is a return time during which the voltage having a value closer to the polarity opposite to the transfer direction relative to the midpoint voltage value Voff is output. Vr represents a return peak value of the voltage from the power source 39 in use. Vt represents a minimum transfer-direction peak value. Vpp represents the peak-to-peak voltage which is the difference between Vr and Vt employed in transfer process.

According to the present illustrative embodiment, the Duty is expressed by B/(A+B), and both A and B are time. In some embodiments, A and B may represent an area. In some embodiments, as a value representing a relation of the midpoint voltage Voff and the time-averaged voltage value Vave, a ratio of an area at the return direction side relative to the midpoint voltage value Voff to the entire AC waveform is set as the Duty. That is, in some embodiments, the Duty is expressed by the following equation: Duty=B1/(A1+B1), where B1 is the area at the return direction side relative to the midpoint voltage value Voff, A1 is the area at the transfer direction side relative to the midpoint voltage value Voff in one cycle of the waveform of the voltage that alternates.

With reference to FIGS. 17 through 26, a description is provided of examples of output waveforms of the AC component in the secondary transfer bias output from the power source 39 according to the illustrative embodiments.

Figure 17:
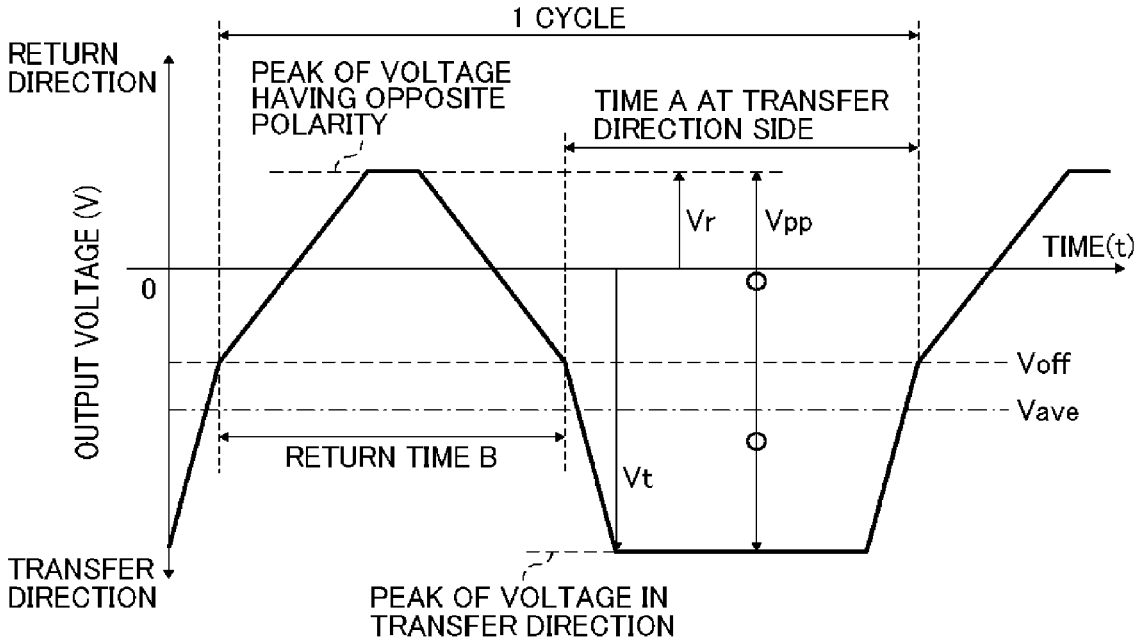
FIG. 17 is a waveform chart showing an example of a waveform of a secondary transfer bias output from the power source controlled by a controller.

In FIG. 17, in one example, the output waveform from the power source is a trapezoid waveform in which the inclination of rising and falling of the voltage at the return direction side is less than that at the transfer direction side. In this example, the return time B is shorter than the time A at the transfer direction side. (A>B) The Duty, i.e., the return time ratio is 40%.

Figure 18:
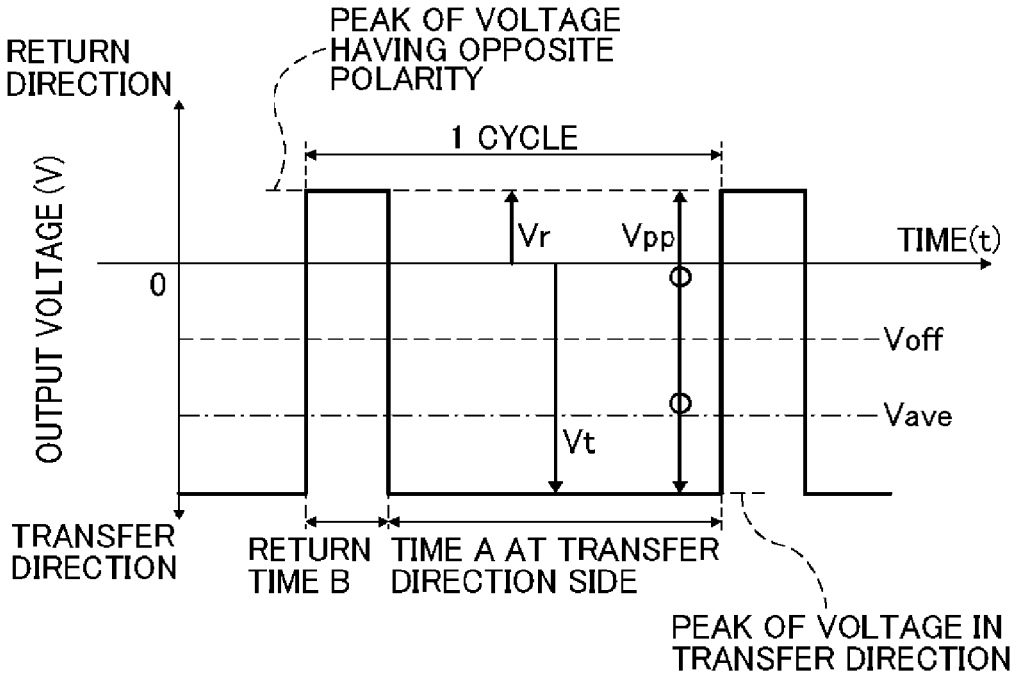
FIG. 18 is a waveform chart showing an example of a waveform of a secondary transfer bias output from the power source controlled by the controller.

In FIG. 18, the waveform has a rectangular shape, and the return time B is shorter than the time A at the transfer direction side. In this example, the return time B is shorter than the time A at the transfer direction side. (A>B) The Duty, i.e., the return time ratio is 40%.

Figure 19:
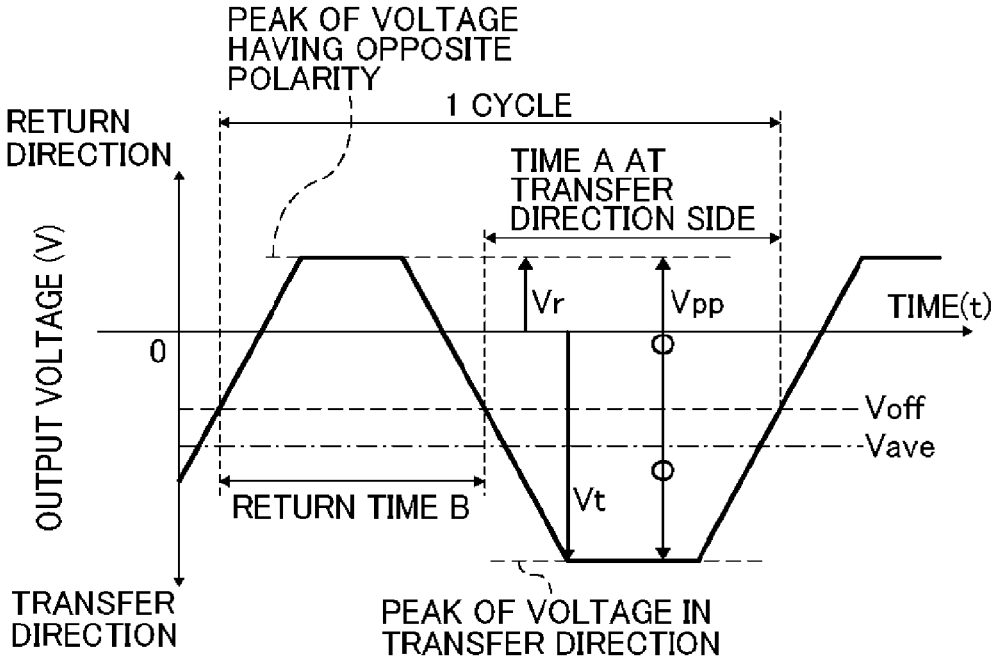
FIG. 19 is a waveform chart showing an example of a waveform of a secondary transfer bias output from the power source controlled by the controller.

In FIG. 19, in one example, the output waveform is a trapezoid waveform in which the inclination of rising and falling of the voltage at the return direction side is less than that at the transfer direction side. In this example, the return time B is shorter than the time A at the transfer direction side. (A>B) The Duty, i.e., the return time ratio is 45%.

Figure 20:
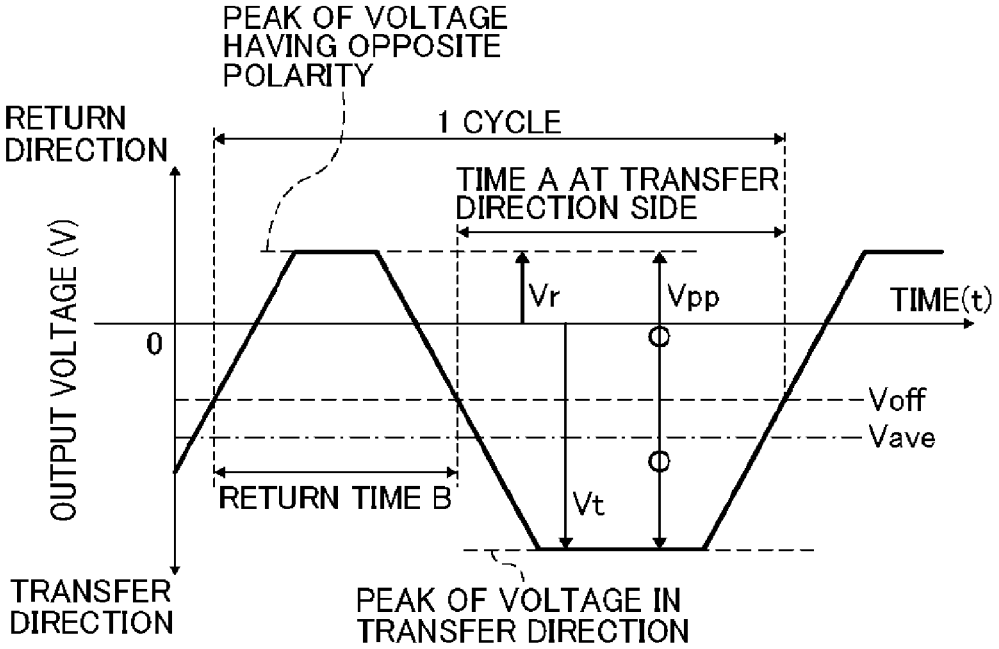
FIG. 20 is a waveform chart showing an example of a waveform of a secondary transfer bias output from the power source controlled by the controller.

In FIG. 20, in one example, the output waveform is a trapezoid waveform in which the inclination of rising and falling of the voltage at the return direction side is less than that at the transfer direction side. In this example, the return time B is shorter than the time A at the transfer direction side. (A>B) The Duty, i.e., the return time ratio is 40%.

Figure 21:
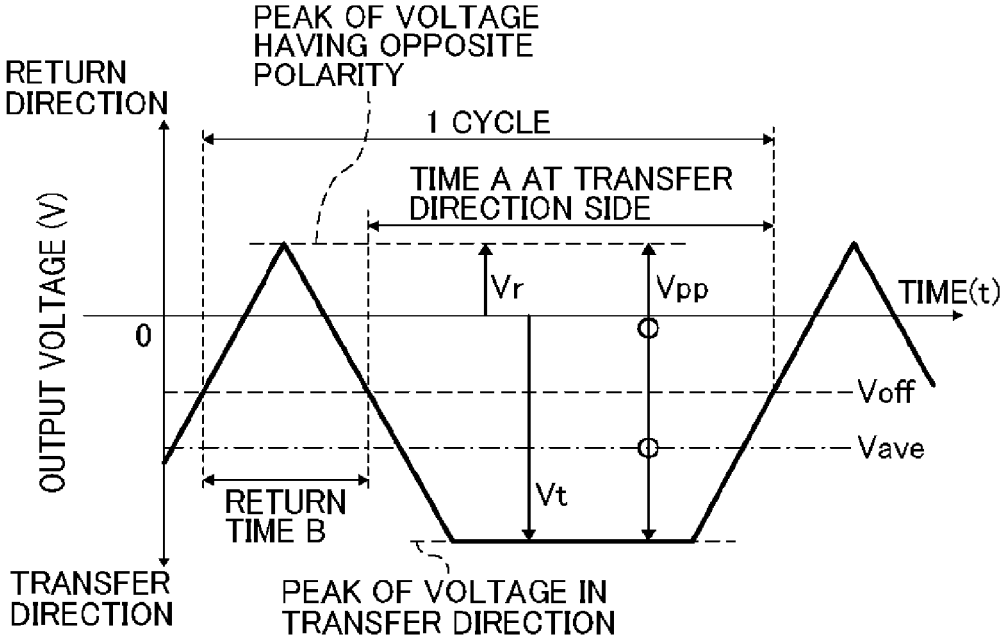
FIG. 21 is a waveform chart showing an example of a waveform of a secondary transfer bias output from the power source controlled by the controller.

In FIG. 21, in one example, the output waveform is a combination of a triangular waveform and a trapezoid waveform, in which the inclination of rising and falling of the voltage at the return direction side is less than that at the transfer direction side. In this example, the return time B is shorter than the time A at the transfer direction side. (A>B) The Duty, i.e., the return time ratio is 32%.

Figure 22:
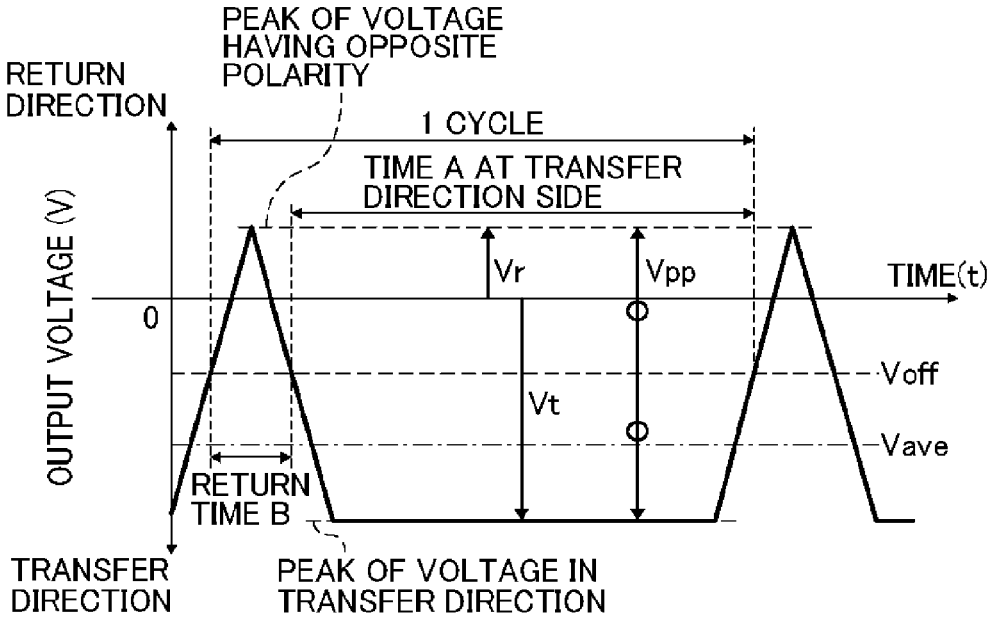
FIG. 22 is a waveform chart showing an example of a waveform of a secondary transfer bias output from the power source controlled by the controller.

In FIG. 22, in one example, the output waveform is a combination of a triangular waveform and a trapezoid waveform, in which the inclination of rising and falling of the voltage at the return direction side is less than that at the transfer direction side. In this example, the return time B is shorter than the time A at the transfer direction side. (A>B) The Duty, i.e., the return time ratio is 16%.

Figure 23:
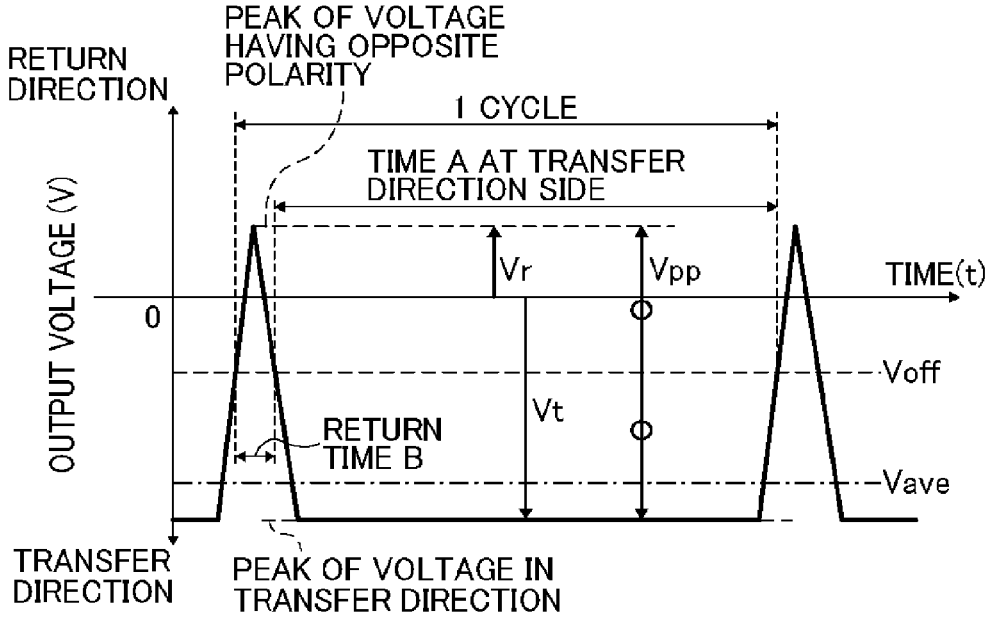
FIG. 23 is a waveform chart showing an example of a waveform of a secondary transfer bias output from the power source controlled by the controller.

In FIG. 23, in one example, the output waveform is a combination of a triangular waveform and a trapezoid waveform, in which the inclination of rising and falling of the voltage at the return direction side is less than that at the transfer direction side. In this example, the return time B is shorter than the time A at the transfer direction side. (A>B) The Duty, i.e., the return time ratio is 8%.

Figure 24:
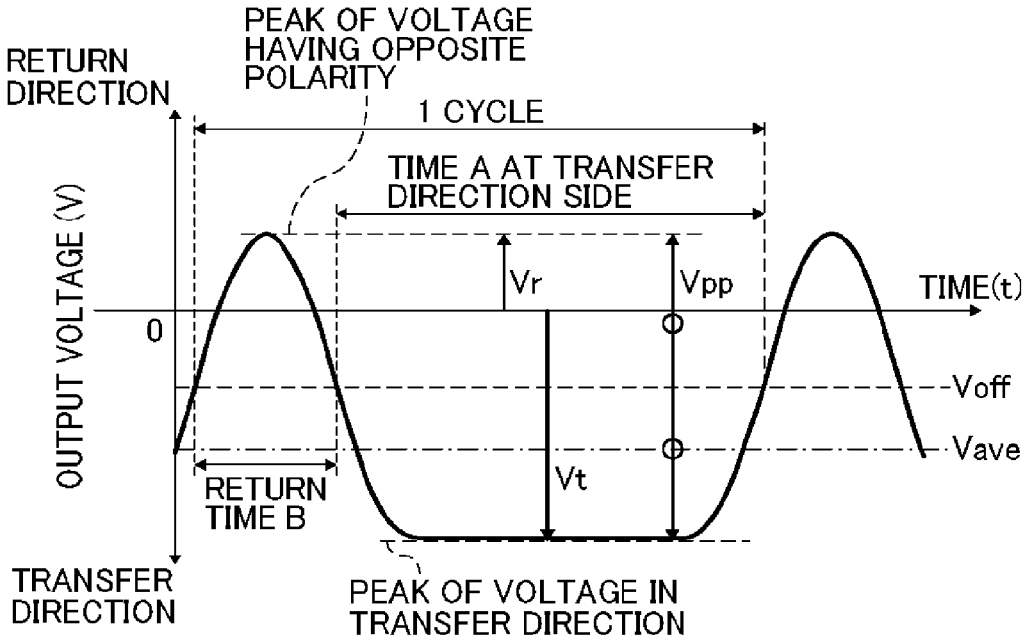
FIG. 24 is a waveform chart showing an example of a waveform of a secondary transfer bias output from the power source controlled by the controller.

In FIG. 24, in one example, the output waveform is a rounded waveform in which the inclination of rising and falling of the voltage at the return direction side is less than that at the transfer direction side. In this example, the return time B is shorter than the time A at the transfer direction side. (A>B) The Duty, i.e., the return time ratio is 16%.

Figure 25:
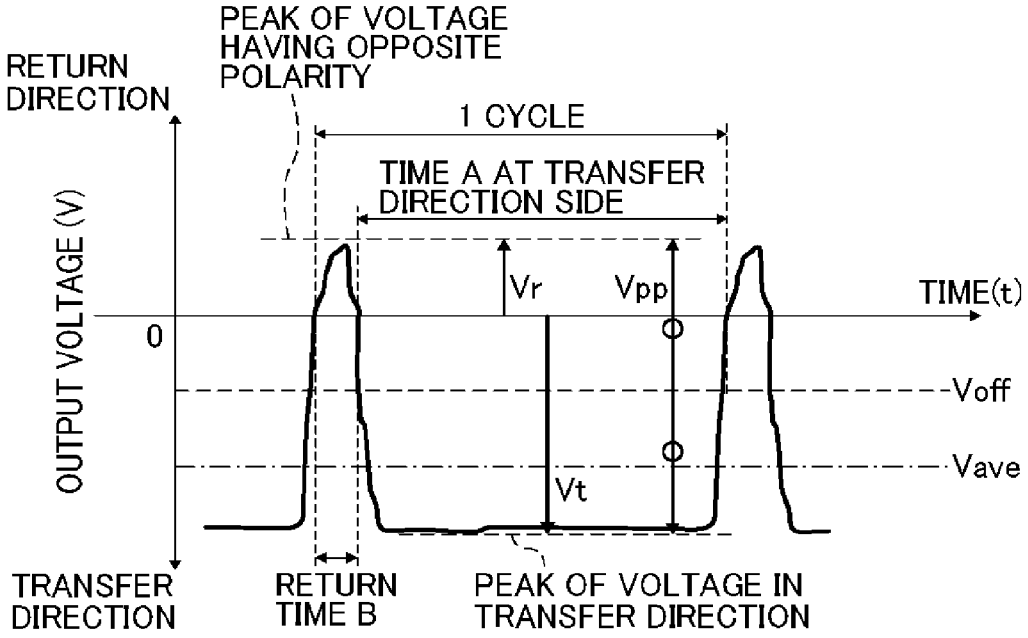
FIG. 25 is a waveform chart showing an example of a waveform of a secondary transfer bias output from the power source controlled by the controller.

FIG. 25 shows a waveform under an assumption that an electrostatic capacity at the secondary transfer nip N is 170 pF (picofarad) and a resistance is 17 MΩ. In this example, the return time B is shorter than the time A at the transfer direction side. (A>B) In this example, the return time B is shorter than the time A at the transfer direction side. (A>B) The Duty, i.e., the return time ratio is 12%.

Figures 26, 27:
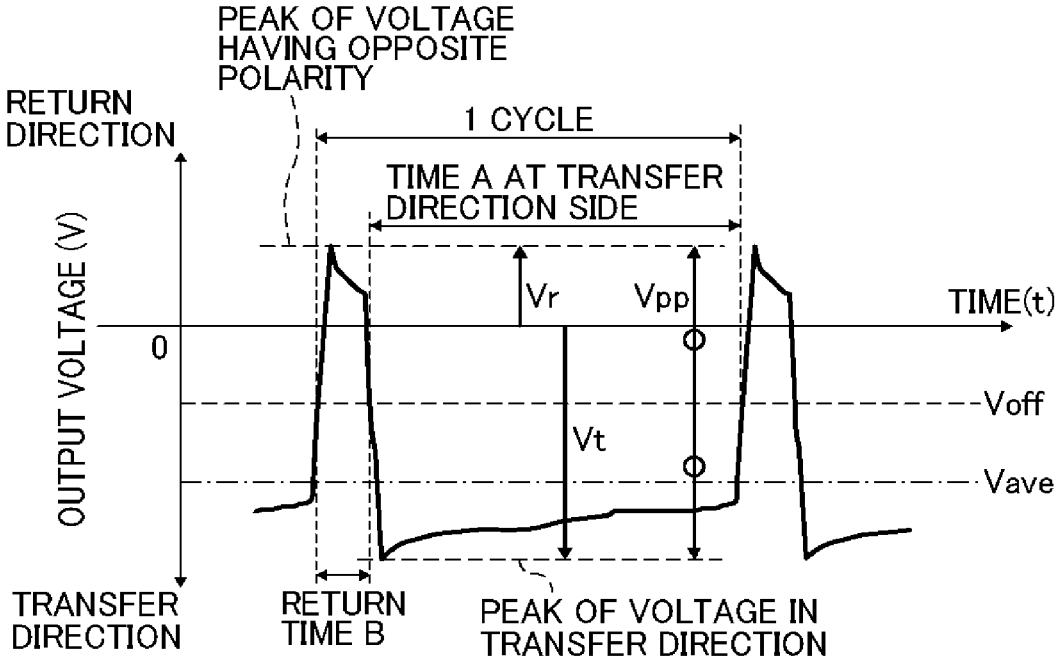
FIG. 26 is a waveform chart showing an example of a waveform of a secondary transfer bias output from the power source controlled by the controller.
FIG. 27 is a table showing a relation of sheet types of recording media and a degree of roughness.

FIG. 26 shows a waveform under an assumption that an electrostatic capacity at the secondary transfer nip N is 120 pF (picofarad) and a resistance is 15 MΩ. In this example, the return time B is shorter than the time A at the transfer direction side. (A>B) The Duty, i.e., the return time ratio is 12%.

A description is provided of Embodiments 1 through 4 and comparative examples 1 through 6 below. In each embodiment, the controller 60 controls the power source 39 to output a voltage. The configurations of Embodiment 1 through 4 all have the same configurations as all the others differing in reference parameters for control. FIG. 27 lists recording media P used in Embodiment 1 through 4. In FIG. 27 names of the recording media and the basis weight (grams per square meter) are shown. In FIGS. 28A and 28B, a depth of a recessed portion of a recording medium represents the degree of roughness of the recording medium. The greater is the depth of the recessed portion, the greater is the degree of roughness.

In FIGS. 28A and 28B, the depth of a recessed portion is indicated as "SMALL", "MEDIUM", and "THICK". "SMALL" refers to the shallowest depth. "LARGE" refers to the deepest depth. "MEDIUM" is intermediate between "SMALL" and "LARGE". In FIGS. 29A and 29B, the thickness of the recording medium P is indicated as "THIN", "MEDIUM", and "THICK". "THIN" refers to the thinnest. "THICK" refers to the thickest. "MEDIUM" is intermediate between "THIN" and "THICKEST".

In each embodiment, transferability and electrical discharge at the recessed portion are graded.

[Transferability]

Transferability at the recessed portion was evaluated as follows.

When toner is transferred adequately to the recessed portion of the recording medium P so that adequate image density is obtained at the recessed portion, it is graded as "EXCELLENT".

When an area having white spots (i.e., missing toner) in the recessed portion is small or the image density at the recessed portion is slightly lower than a smooth portion of the recording medium, it is graded as "GOOD".

When the area having white spots is greater than "GOOD" or the image density is significantly low, it is graded as "FAIR".

As compared with the transferability graded as "FAIR", when the overall recessed portion is white and hence the recessed portion is easily recognized or even worse, it is graded as "POOR".

[Electrical Discharge] In the secondary transfer nip N, an electrical discharge is generated in a slight gap between the recessed portion of the recording medium P and the intermediate transfer belt 31 depending on the secondary transfer bias, thereby generating white spots in an image. Appearance of white spots due to the electrical discharge is graded as follows. When there is no white spot due to electrical discharge, it is graded as "GOOD". When the white spots due to electrical discharge are NOT recognized, it is graded as "GOOD". By contrast, when the white spots due to electrical discharge are recognized, it is graded as "POOR".

EMBODIMENT 1

According to Embodiment 1, the image forming apparatus of FIG. 1 is employed. In the present illustrative embodiment, the controller 60 controls the power source 39 to increase the Duty expressed by "B/(A+B)" as the peak-to-peak voltage Vpp increases and to reduce the Duty as the peak-to-peak voltage Vpp decreases. Furthermore, the Duty is increased with an increase in the roughness of the recording medium P. Here, B refers to an application time at the return direction side relative to the midpoint voltage value Voff, and A refers to an application time at the transfer direction side relative to the midpoint voltage value Voff in one cycle of the waveform of the voltage that alternates. The evaluation of Embodiment 1 is shown in FIG. 28A.

FIG. 28B shows the evaluation of Comparative Example 1 as compared with Embodiment 1. In Comparative Example 1, the different types of recording media were used, and the peak-to-peak voltage Vpp and Duty were not changed. In this case, the greater was the depth of the recessed portion of the recording medium P, the lower was the grade of the transferability at the recessed portion. However, the electrical discharge was not affected by the depth of the recessed portion.

By contrast, according to Embodiment 1, when the peak-to-peak voltage Vpp and the duty were increased with an increase in the depth of the recessed portion, the time-averaged value Vave of the voltage changed. That is, when the depth of the recessed portion is relatively large and the Duty is increased, an absolute value of the time-averaged value Vave of the voltage increases, hence improving the grade of the transferability at the recessed portion. That is, the transferability increases so that adequate image density is obtained both at the recessed portion and the projecting portion of the recording medium, thereby suppressing generation of the white spots and hence obtaining a desired image quality.

EMBODIMENT 2

According to Embodiment 2, the image forming apparatus of FIG. 1 is employed. In the present illustrative embodiment, the controller 60 controls the power source 39 to increase the Duty expressed by "B/(A+B)" as the peak-to-peak voltage Vpp increases and to reduce the Duty as the peak-to-peak voltage Vpp decreases. Furthermore, the Duty is increased with an increase in the thickness of the recording medium P. Here, B refers to an application time at the return direction side relative to the midpoint voltage value Voff, and A refers to an application time at the transfer direction side relative to the midpoint voltage value Voff in one cycle of the waveform of the voltage that alternates. The evaluation of Embodiment 2 is shown in FIG. 29A.

FIG. 29B shows the evaluation of Comparative Example 2 as compared with Embodiment 2. In Comparative Example 2, recording media having different thicknesses were used, the Duty (return time ratio %) was not changed, and the peak-to-peak voltage Vpp was changed. In this case, when the peak-to-peak voltage Vpp was increased with an increase in the thickness of the recording medium P, the transferability decreased, but electrical discharge did not occur. When the thickness of the recording medium P was relatively large, increasing the peak-to-peak voltage could improve the transferability at the recessed portion, but electrical discharge occurred.

By contrast, according to Embodiment 2, when the peak-to-peak voltage Vpp and the duty were increased with an increase in the thickness of the recording medium P, the time-averaged value Vave of the voltage changed. That is, when the thickness of the recording medium P is relatively large and the peak-to-peak voltage Vpp and the Duty are increased, an absolute value of the time-averaged value Vave of the voltage increases, hence improving the grade of the transferability at the recessed portion. In other words, the transferability increases so that adequate image density is obtained both at the recessed portion and the projecting portion of the recording medium, thereby suppressing generation of the white spots and hence obtaining a desired image quality.

EMBODIMENT 3

According to Embodiment 3, the image forming apparatus of FIG. 1 is employed. In the present illustrative embodiment, the controller 60 controls the power source 39 to increase the Duty expressed by "B/(A+B)" as the peak-to-peak voltage Vpp increases and to reduce the Duty as the peak-to-peak voltage Vpp decreases. Furthermore, the Duty is increased with a decrease in temperature or humidity detected by the environment detector 52. Here, B refers to an application time at the return direction side relative to the midpoint voltage value Voff, and A refers to an application time at the transfer direction side relative to the midpoint voltage value Voff in one cycle of the waveform of the voltage that alternates. The evaluation of Embodiment 3 is shown in FIG. 30A.

FIG. 30B shows the evaluation of Comparative Example 3 as compared with Embodiment 3. In Comparative Example 3, the recording media of the same type were used and the peak-to-peak voltage Vpp and Duty were unchanged while changing the temperature and the humidity. In Comparative Example 3, as the temperature and the humidity decreased, the transferability at the recessed portion degraded.

FIG. 30C shows the evaluation of Comparative Example 4 as compared with Embodiment 3. In Comparative Example 4, the recording media of the same type were used and the Duty was unchanged while changing the peak-to-peak voltage Vpp and the temperature and the humidity. In Comparative Example 4, the peak-to-peak voltage Vpp was increased with a decrease in the temperature and the humidity. However, as the temperature and the humidity decreased, the transferability at the recessed portion degraded. Although increasing the peak-to-peak voltage Vpp at a relatively low temperature could improve the transferability, electrical discharge occurred.

By contrast, according to Embodiment 3, when not only the peak-to-peak voltage Vpp but also the Duty is increased as the temperature and/or the humidity decreases, the absolute value of the time-averaged value Vave of the voltage increases and hence the grade on the transferability at the recessed portion is enhanced while keeping the grade of the electrical discharge high. The transferability increases so that adequate image density is obtained both at the recessed portion and at the projecting portion of the recording medium P, thereby suppressing generation of the white spots and hence obtaining a desired image quality.

EMBODIMENT 4

According to Embodiment 4, the image forming apparatus of FIG. 1 is employed. In the present illustrative embodiment, the controller 60 controls the power source 39 to increase the Duty expressed by "B/(A+B)" as the peak-to-peak voltage Vpp increases and to reduce the Duty as the peak-to-peak voltage Vpp decreases. Furthermore, the Duty is increased with an increase in the electrical resistance detected by the resistance detector 53. Here, B refers to an application time at the return direction side relative to the midpoint voltage value Voff, and A refers to an application time at the transfer direction side relative to the midpoint voltage value Voff in one cycle of the waveform of the voltage that alternates. The evaluation of Embodiment 4 is shown in FIG. 31A.

FIG. 31C shows the evaluation of Comparative Example 5 as compared with Embodiment 4. In Comparative Example 5, the recording media of the same type were used, the peak-to-peak voltage Vpp and Duty were not changed, and only the resistance of parts was changed. In the present comparative example, there was a tendency that the higher was the resistance, the lower was the grade of the transferability at the recessed portion of the recording medium. Also, the lower was the resistance, the lower was the grade of the electrical discharge.

FIG. 31C shows the evaluation of Comparative Example 6 as compared with Embodiment 4. In Comparative Example 6, the recording media of the same type were used, the Duty was not changed, and the peak-to-peak voltage Vpp and the resistance of parts were changed. In Comparative Example 6, the duty was increased with an increase in the electrical resistance. In Comparative Example 6, the peak-to-peak voltage Vpp was set higher than that in Comparative Example 5, and the peak-to-peak voltage Vpp was increased with an increase in the electrical resistance. Thus, the grade on the transferability at the recessed portion tends to be higher than Comparative Example 5.

By contrast, according to the illustrative embodiment, when not only the peak-to-peak voltage Vpp but also the Duty was increased with an increase in the electrical resistance, the absolute value of the time-averaged value Vave of the voltage increased and hence the grade on the transferability at the recessed portion was enhanced regardless of the electrical resistance. The transferability increases so that adequate image density is obtained both at the recessed portion and at the projecting portion of the recording medium P, thereby suppressing generation of the white spots and hence obtaining a desired image quality.

In Embodiment 4 and Comparative Examples 5 and 6, changes in the target peak-to-peak voltage Vpp preset in the controller 60 and the measured peak-to-peak voltage Vpp were compared. The measured peak-to-peak voltage Vpp was calculated by the controller 60 using the electrical resistance detected by the resistance detector 53. The preset target peak-to-peak voltage Vpp is determined based on an output time of the power source 39 which corresponds to a theoretical set value.

In Comparative Examples 5 and 6, there is a difference between the set value and the measured value of the peak-to-peak voltage Vpp. That is, the measured value is lower than the target set value. It is inferred that in Comparative Example 5 a necessary level of the peak-to-peak voltage Vpp for transfer cannot be obtained with an increase in the electrical resistance, hence decreasing the transferability at the recessed portion. In Comparative Example 6, the peak-to-peak voltage Vpp is increased with an increase in the electrical resistance. However, there is no change in the measured value. It is also inferred that a necessary level of the peak-to-peak voltage Vpp for transfer cannot be obtained with an increase in the electrical resistance, hence decreasing the transferability at the recessed portion.

By contrast, in Embodiment 4, the set value and the measured value of the peak-to-peak voltage Vpp correspond to each other. In other words, the measured value does not get lower than the target set value. This is because the Duty is increased with an increase in the electrical resistance, thereby increasing the total amount of the voltage at the transfer direction side (Vt) and hence increasing the peak-to-peak voltage Vpp. The transferability increases so that adequate image density is obtained both at the recessed portion and at the projecting portion of the recording medium P, thereby suppressing generation of the white spots and hence obtaining a desired image quality regardless of the electrical resistance.

Next, a description is provided of effects of controlling the power source 39 to increase the Duty with an increase in the peak-to-peak voltage Vpp and reduce the Duty with a decrease in the peak-to-peak voltage Vpp.

Figure 32:
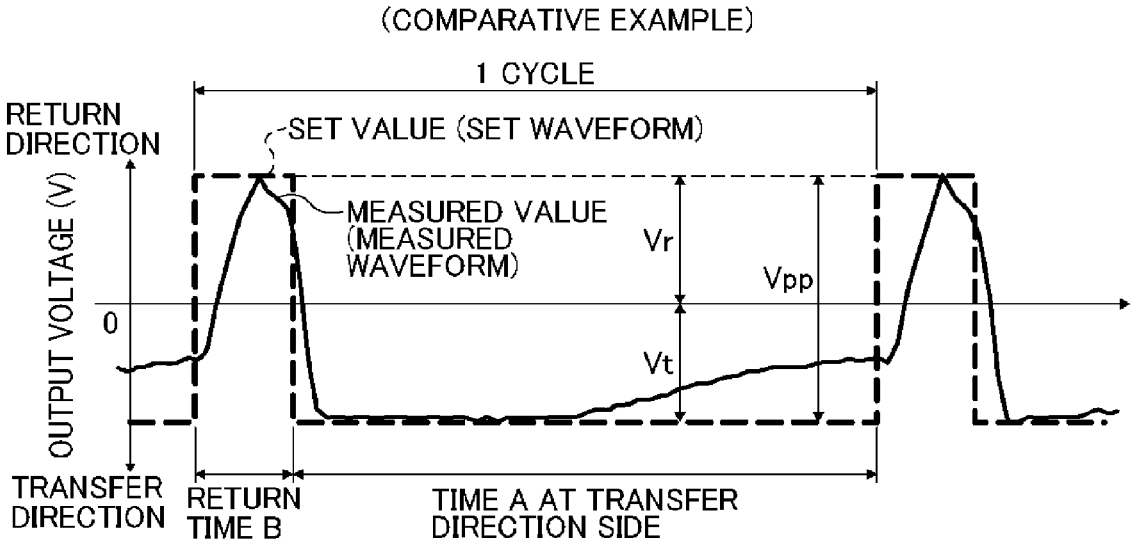
FIG. 32 is a waveform chart showing a waveform of a voltage before increasing the duty.
Figure 33:
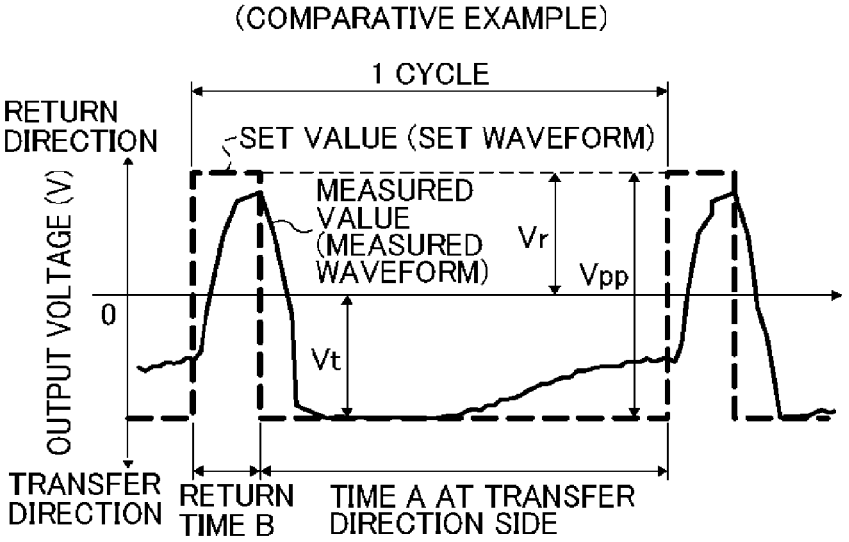
FIG. 33 is a waveform chart showing a waveform of a voltage after increasing the duty.

FIG. 32 shows a set waveform and a measured waveform when an output waveform shown in FIG. 18 is a square wave. FIG. 33 shows a set waveform and a measured waveform when increasing the peak-to-peak voltage Vpp while the Duty remains unchanged. FIG. 36 is a table showing a relation between the target value (set value) and the measured value of the peak-to-peak voltage Vpp, and the Duty according to the illustrative embodiments of the present disclosure shown in FIGS. 34 and 35.

The present inventor has recognized that even when the controller 60 controls the power source 39 to output the secondary transfer bias having the preset target waveform, the measured waveform hardly achieves the preset target waveform. Rather, the measured waveform always has That is, as can be understood from FIGS. 32, 33, and 36, when increasing simply the peak-to-peak voltage Vpp and the Duty is constantly low, the polarity of the AC component of the secondary transfer bias is switched before reaching the desired peak-to-peak voltage Vpp, hence complicating efforts to obtain a relatively large peak-to-peak voltage Vpp.

In view of the above, according to the illustrative embodiment, not only the peak-to-peak voltage Vpp, but also the Duty is changed. Furthermore, the direction of change in the peak-to-peak voltage Vpp and the direction of change in the Duty coincide with each other. In other words, the controller 60 controls the power source 39 to increase the Duty with an increase in the peak-to-peak voltage Vpp, and to reduce the Duty with a decrease in the peak-to-peak voltage Vpp.

Figure 34:
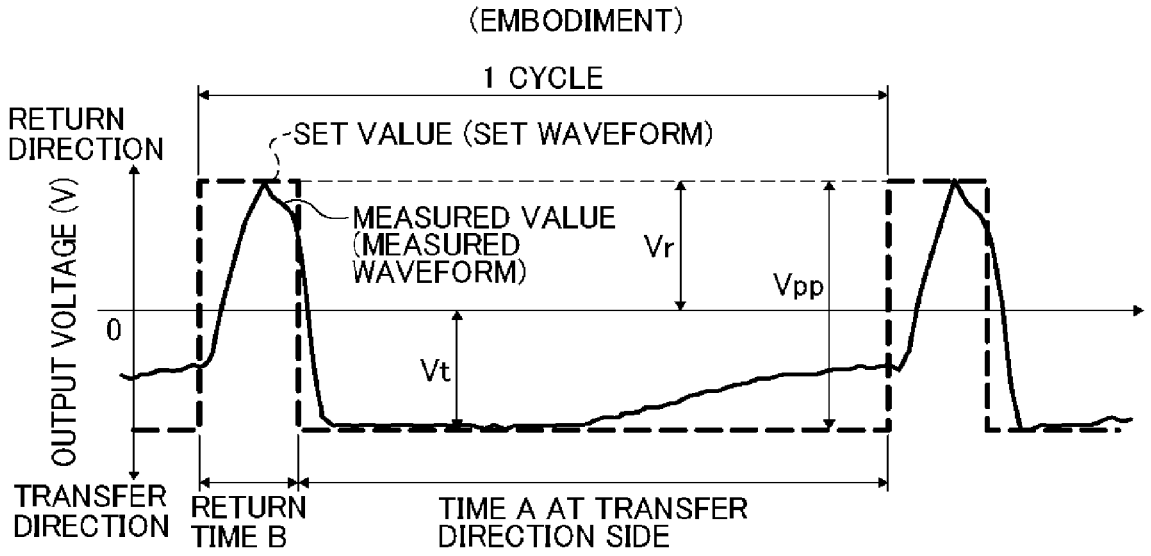
FIG. 34 is a waveform chart showing a waveform of a voltage before increasing the duty according to an illustrative embodiment of the present disclosure.
Figure 35:
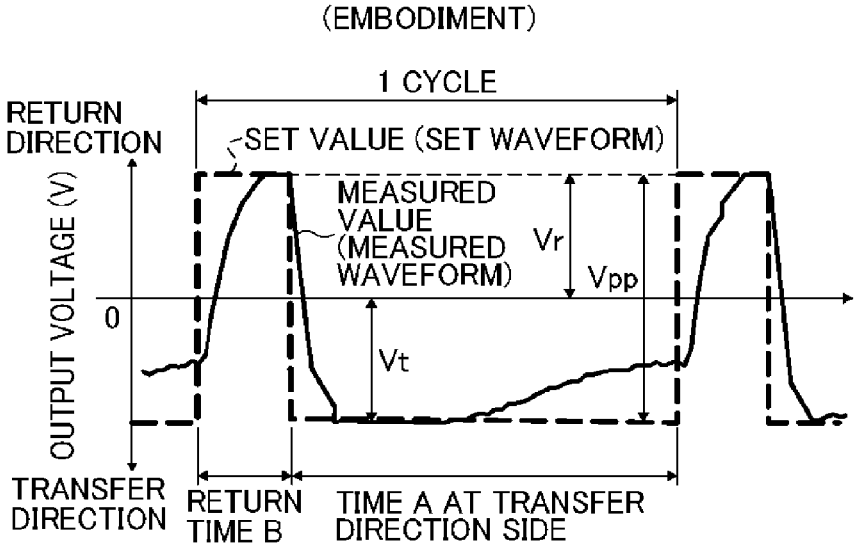
FIG. 35 is a waveform chart showing a waveform of a voltage after increasing the duty according to an illustrative embodiment of the present disclosure.

FIGS. 34 and 35 show the set waveform and the measured waveform when the control according to the illustrative embodiment is carried out. FIG. 34 shows a set waveform and a measured waveform when an output waveform is a square wave. FIG. 35 shows a set waveform and a measured waveform when increasing the Duty and the peak-to-peak voltage Vpp.

As can be understood from FIGS. 34, 35, and 36, the desired peak-to-peak voltage Vpp can be obtained by increasing the Duty with an increase in the peak-to-peak voltage Vpp even when the peak-to-peak voltage Vpp is relatively large.

When the secondary transfer bias includes the AC electric field, the smaller is the Duty the better is the transferability as long as the desired peak-to-peak voltage Vpp is obtained. In order to transfer toner to the recording medium P, the time-averaged value Vave for voltage in accordance with different types and sizes of recording media is necessary. However, the value is not changed by the Duty. The value remains constant. In order to vibrate the toner between the intermediate transfer belt 31 and the recording medium P, the return peak value Vr in the return direction is necessary, but this value is not also changed by the Duty. That is, since the time-averaged value Vave for the desired voltage and the return peak value Vr at the return-direction side do not change, the peak-to-peak voltage Vpp increases as the Duty increases, causing a failure such as electrical discharge. In view of the above, the Duty is reduced so as to reduce the peak-to-peak voltage Vpp.

If the peak-to-peak voltage Vpp is increased as the thickness of the recording medium P increases while the duty is constant such as in Comparative Example 2, vibration of toner between the intermediate transfer belt 31 and the recording medium P gets more active. In this configuration, although irregular density can be reduced, electrical discharge occurs. By contrast, if the peak-to-peak voltage Vpp and the Duty are increased as the thickness of the recording medium P increases such as in Embodiment 2, irregular density can be reduced while preventing electrical discharge.

In a case in which the recording medium P is relatively thin, the roughness of the recording medium P is relatively low and white spots (toner dropouts) due to electrical discharge are more pronounced than irregular density. By contrast, in a case in which the recording medium P is relatively thick, irregular density is more pronounced than white spots. Therefore, the power source 39 is controlled to increase the Duty with an increase in the peak-to-peak voltage Vpp and also with an increase in the thickness of the recording medium P. With this configuration, transferability at the recessed portion can be enhanced by adequate oscillation of toner when the recording medium P is relatively thick. Furthermore, the Duty is reduced as the peak-to-peak voltage Vpp decreases, thereby reducing the transfer-direction peak value Vt and hence reducing the maximum voltage. With this configuration, electrical discharge is difficult to occur when using a thin recording medium P.

FIG. 37 is a table showing changes in the transfer-direction peak value Vt when the duty is changed while the return peak value Vr and the time-averaged value Vave of the voltage are fixed.

As shown in FIG. 37, when the duty is changed while the return peak value Vr and the time-averaged value Vave of the voltage are fixed, the transfer-direction peak value Vt increases with an increase in the duty and hence the transferability at the recessed portion can be enhanced.

As described above, when using the recording medium P that requires a relatively high peak-to-peak voltage Vpp, the return peak value Vr is increased by increasing the Duty and hence the transferability at the recessed portion can be enhanced. When using the recording medium P that allows a peak-to-peak voltage Vpp providing low transferability at the recessed portion and low discharging ability, the Duty is reduced so that the risk of electrical discharge at the return peak value Vr side can be reduced.

According to the illustrative embodiments and Embodiments 1 through 4, the waveform of the secondary transfer bias from the power source 39 is detected by the waveform detector 55, and the controller 60 adjusts the duty in accordance with an increase and decrease of the peak-to-peak voltage Vpp based on the detected output waveform detected by the waveform detector 55. Based on the measured value, the controller 60 adjusts the peak-to-peak voltage Vpp and the duty.

Figure 38:
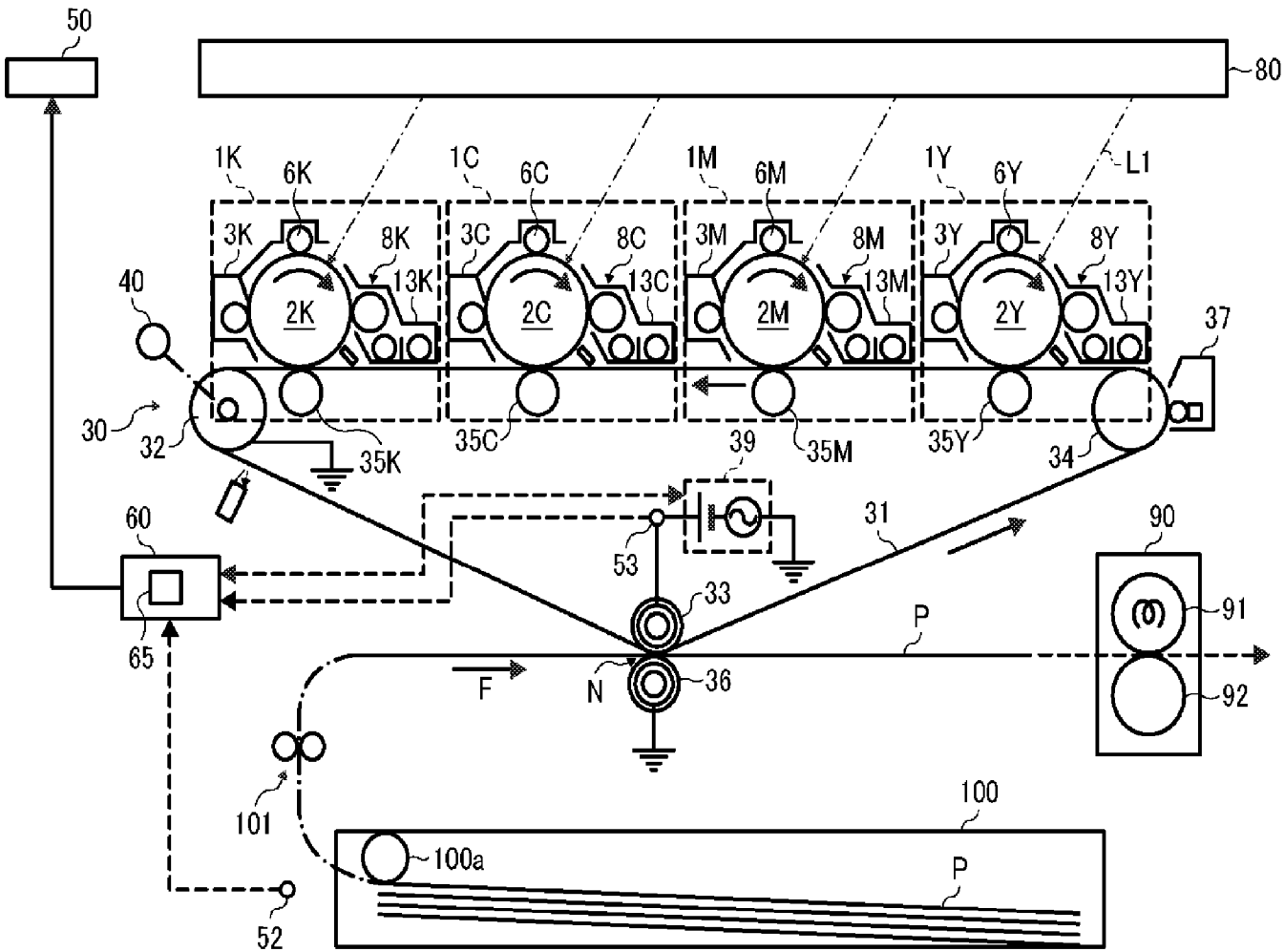
FIG. 38 is a schematic diagram illustrating an example of an image forming apparatus according to another illustrative embodiment of the present disclosure.

However, the illustrative embodiments of the present disclosure are not limited thereto. FIG. 38 illustrates an image forming apparatus according to another illustrative embodiment of the present disclosure. The image forming apparatus shown in FIG. 38 includes a setup device 65 that sets an output timing at which the power source 39 outputs the voltage, in place of the waveform detector 55. Based on the output timing set by the setup device 65, the controller 60 controls the power source 39 such that the Duty expressed by B/(A+B) is increased with an increase in the difference between the maxim voltage and the minimum voltage (i.e., peak-to-peak voltage Vpp), and the Duty is decreased with a decrease in the difference between the maxim voltage and the minimum voltage (i.e., peak-to-peak voltage Vpp).

Figure 39:
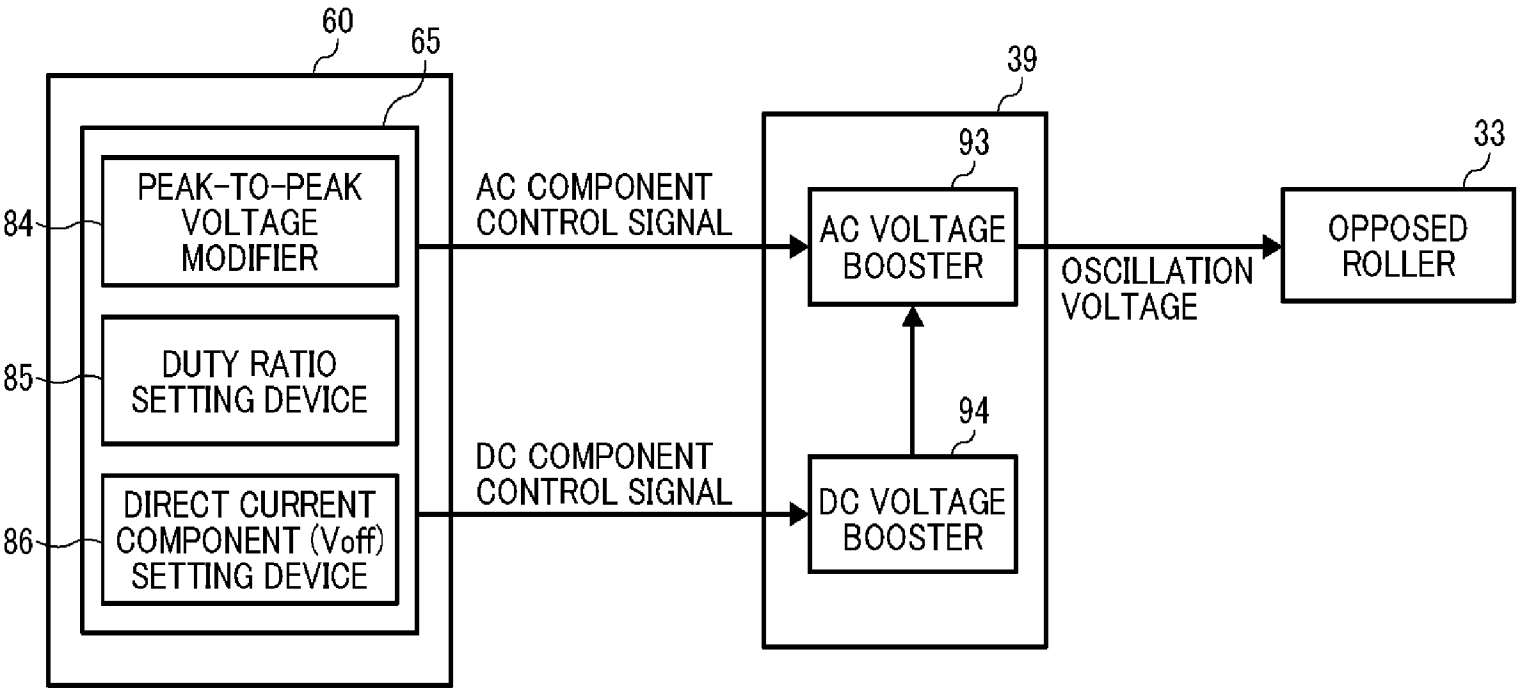
FIG. 39 is a block diagram illustrating a setting device and the controller according to an illustrative embodiment of the present disclosure.

With reference to FIG. 39, a description is provided of the setup device 65, the controller 60, waveform setting and the power control according to another illustrative embodiment.

According to the present illustrative embodiment, the setup device 65 constitutes a part of the controller 60. However, the setup device 65 may be independent from the controller 60. The setup device 65 includes a peak-to-peak voltage modifier 84, a duty ratio setting device 85, and a DC component (Voff) setting device 86. The peak-to-peak voltage modifier 84 changes the peak-to-peak voltage of the control signal. The duty ratio setting device 85 changes the duty ratio of the control signal. The peak-to-peak voltage modifier 84 changes the peak-to-peak voltage of the control signal having the AC component to be provided to the power source 39. The duty ratio setting device 85 changes the duty ratio of the control signal having a square wave. The DC component (Voff) setting device 86 sets an output of the DC component Voff relative to the alternating current.

Based on at least one of information such as types of recording media provided by the control panel 50, temperature and humidity information detected by the environment detector 52, and the electrical resistance at the transfer portion detected by the resistance detector 53, the peak-to-peak voltage modifier 84 changes the peak-to-peak voltage Vpp, the duty ratio setting device 85 sets the waveform of the duty, and the DC component (Voff) setting device 86 sets the midpoint voltage value Voff. According to the present illustrative embodiment, the duty, the waveform of which is set by the duty ratio setting device 85, is a time ratio expressed by Y/X, where X is a cycle of the waveform and Y is a time during which the waveform has a polarity that causes the toner image on the recording medium P to return to the intermediate transfer belt 31 side in an X cycle.

The controller 60 sends an AC component control signal and a DC component control signal that correspond to a waveform set by the setup device 65 to the power source 39 serving as the secondary transfer power source. According to the present illustrative embodiment, the power source 39 includes an AC voltage booster 93 and a DC voltage booster 94. Based on the AC component control signal and the DC component control signal from the controller 60, the power source 39 generates an oscillation voltage by superimposing the AC voltage output from the AC voltage booster 93 and the DC voltage output from the DC voltage booster 94. Then, the oscillation voltage thus obtained is output to the opposed roller 33 which is a repulsive-force roller.

In other words, the controller 60 controls the power source 39 to generate, based on the AC component control signal and the DC component control signal, an oscillation voltage by superimposing the AC voltage output from the AC voltage booster 93 and the DC voltage output from the DC voltage booster 94. Then, the oscillation voltage thus obtained is output to the opposed roller 33 which is a repulsive-force roller.

According to the present illustrative embodiment, the setup device 65 includes a function capable of setting and outputting a waveform such that as the peak-to-peak voltage Vpp which is a difference between the maximum value of the set waveform and the minimum value increases, the time ratio (Y/X) increases.

As described above, the time ratio (Y/X) of the waveform set by the setup device 65 and the peak-to-peak voltage Vpp are in a correspondence relation to the oscillation voltage output by the power source 39 to the opposed roller 33. That is, there is a tendency that the greater is the time ratio (Y/X) of the set waveform, the greater is the duty of the oscillation voltage. Furthermore, there is a tendency that the greater is the peak-to-peak voltage Vpp of the set waveform, the greater is the peak-to-peak voltage Vpp of the oscillation voltage. As the setup device 65 sets the waveform such that the time ratio (Y/X) increases with an increase in the peak-to-peak voltage Vpp, the Duty increases with an increase in the peak-to-peak voltage of the oscillation voltage (actual output waveform). With this configuration, even when the peak-to-peak voltage Vpp which is a difference between the maximum and the minimum voltage of the transfer bias increases, good image quality can be attained.

In such an image forming apparatus, as described in Embodiment 1, when the controller 60 controls the power source 39 to increase the duty with an increase in the roughness of the surface of the recording medium P, the same effect as that of Embodiment 1 can be achieved.

In such an image forming apparatus, as described in Embodiment 2, when the controller 60 controls the power source 39 to increase the duty with an increase in the thickness of the recording medium P, the same effect as that of Embodiment 2 can be achieved.

In such an image forming apparatus, as described in Embodiment 3, when the controller 60 controls the power source 39 to increase the duty with a decrease in the temperature or the humidity detected by the environment detector 52, the same effect as that of Embodiment 3 can be achieved.

In such an image forming apparatus, as described in Embodiment 4, when the controller 60 controls the power source 39 to increase the duty with an increase in the electrical resistance detected by the resistance detector 53, the same effect as that of Embodiment 4 can be achieved.

The image forming apparatus is not limited to the configurations illustrated in FIGS. 1 and 38. The illustrative embodiments of the present disclosure can be applied to an image forming apparatus using a drum-shaped intermediate transfer device in place of the intermediate transfer belt 31. Furthermore, the illustrative embodiments of the present disclosure can be applied to an image forming apparatus using a belt-type nip forming member in place of the nip forming roller 36. Furthermore, the illustrative embodiments of the present disclosure can be applied to an image forming apparatus using a so-called direct transfer method in which a transfer roller directly contacts a photoconductor to form a transfer nip, a toner image on the photoconductor is transferred onto a recording medium in the transfer nip by a transfer voltage output by a power source, and the controller controls the power source to output the voltage.

Figure 40:
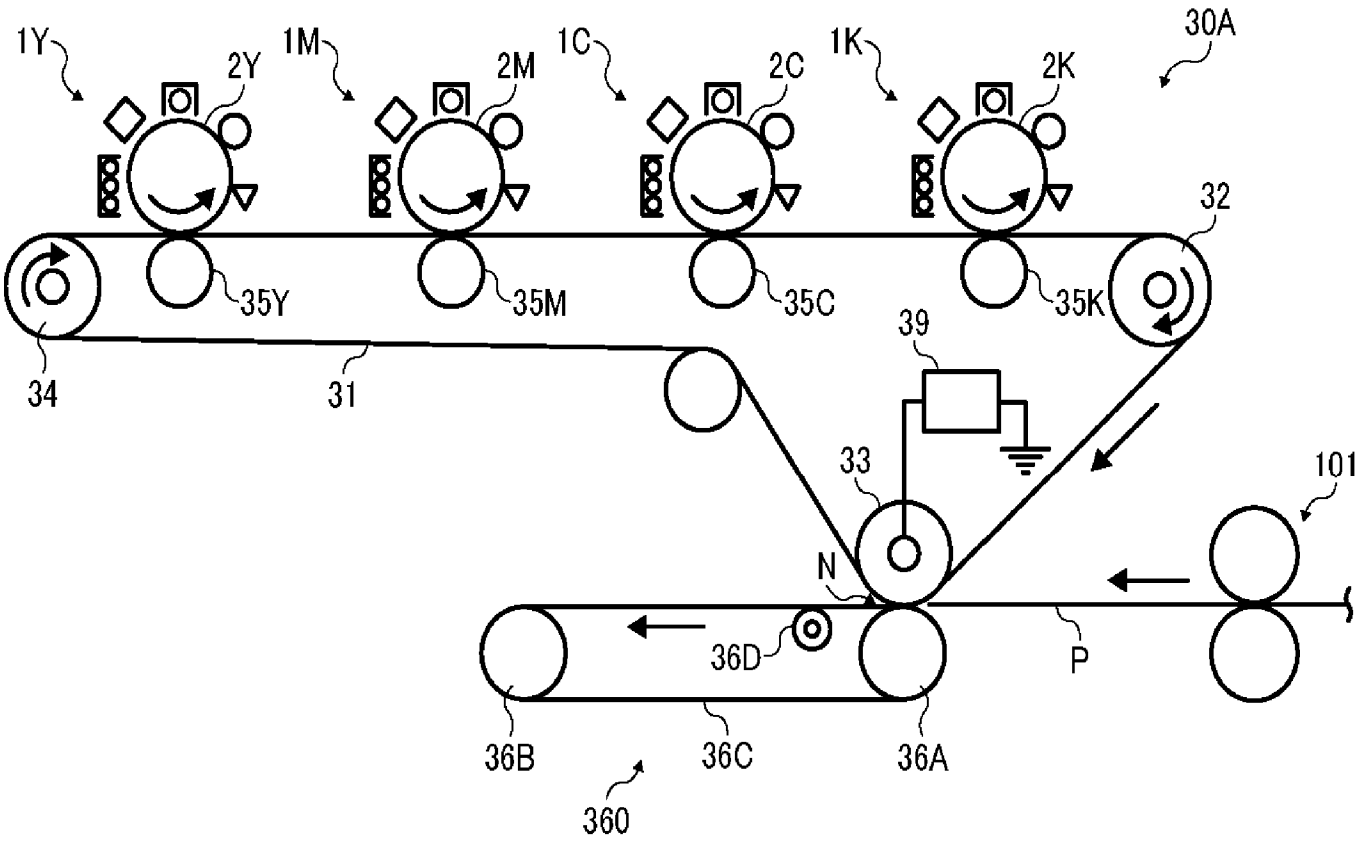
FIG. 40 is an enlarged schematic diagram illustrating another example of a transfer unit.

With reference to FIG. 40, a description is provided of an image forming apparatus according to another illustrative embodiment of the present disclosure. As illustrated in FIG. 40, the image forming apparatus includes a transfer unit 30A in place of the transfer unit 30. In the transfer unit 30A, the intermediate transfer belt 31 serving as an image bearer is formed into a loop and disposed opposite to the image forming unit 1Y, 1M, 1C, and 1K. A secondary transfer conveyor belt 36C serving as a transfer device is disposed opposite to the opposed roller 33 disposed inside the looped intermediate transfer belt 31 and contacts the opposed roller 33 via the intermediate transfer belt 31. In this configuration, the traveling direction of the intermediate transfer belt 31 is opposite to the direction shown in FIGS. 1 and 38.

The secondary transfer conveyor belt 36C is entrained about a drive roller 36A and a driven roller 36B and constitutes a secondary transfer conveyor assembly 360. The intermediate transfer belt 31 and the secondary transfer conveyor belt 36C contact each other at a position at which the opposed roller 33 faces the drive roller 36A, thereby forming a secondary transfer nip N. The secondary transfer conveyor belt 36C receives the recording medium P fed from the pair of registration rollers 101 and transports the recording medium P to the secondary transfer nip N.

According to the present illustrative embodiment, the drive roller 36A is grounded. The opposed roller 33 is supplied with a secondary transfer bias output from the power source 39. The secondary transfer bias supplied from the power source 39 generates a transfer electric field at the secondary transfer nip N that causes the toner image transferred on the intermediate transfer belt 31 to electrostatically move to the secondary transfer conveyor belt 36C side. The toner image on the intermediate transfer belt 31 is transferred onto the recording medium P in the secondary transfer nip N due to the secondary transfer electric field and the nip pressure.

In another example of application of secondary transfer bias, the secondary transfer assembly 360 includes a bias application roller 36D disposed inside the looped secondary transfer conveyor belt 36C to contact the secondary transfer conveyor belt 36C. The power source 39 is connected to the bias application roller 36D to apply the secondary transfer bias to the bias application roller 36D.

Figure 41:
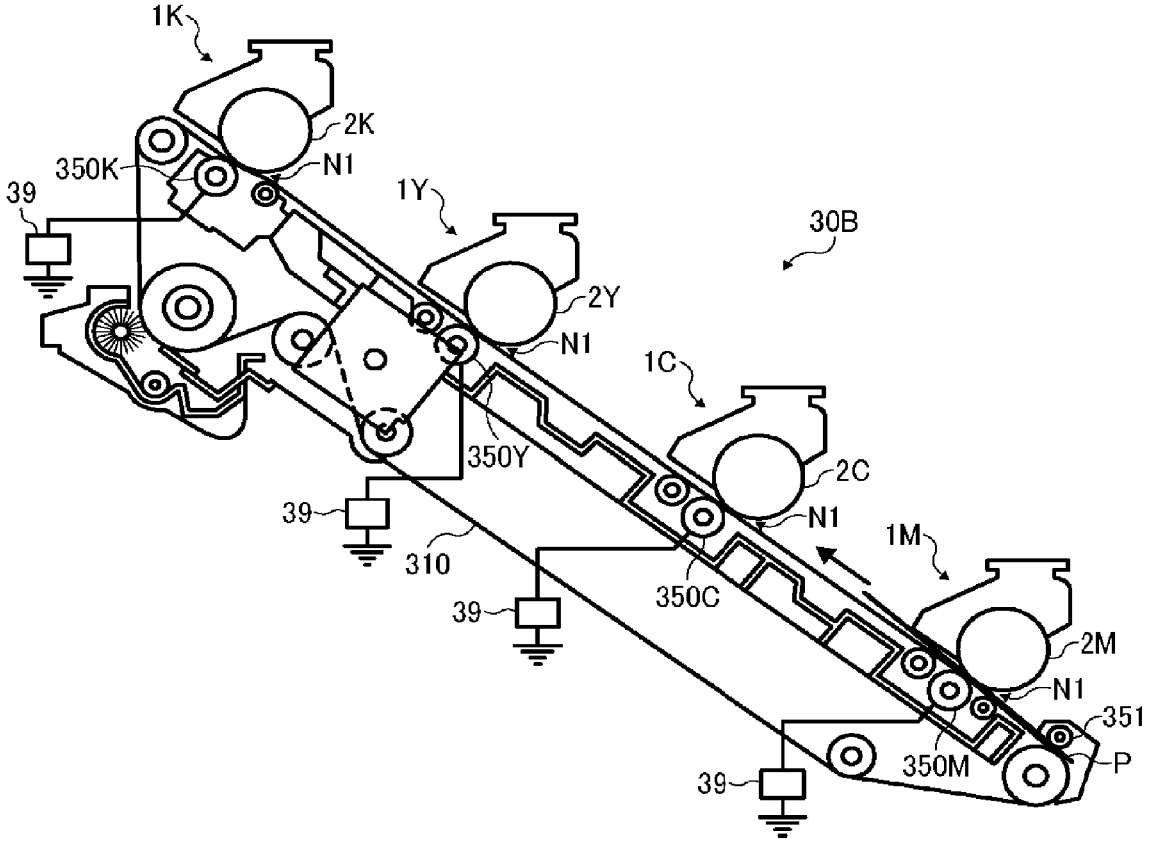
FIG. 41 is an enlarged schematic diagram illustrating another example of the transfer unit.

As illustrated in FIG. 41, the image forming apparatus includes a transfer unit 30B in place of the transfer unit 30. In the transfer unit 30B, a transfer conveyor belt 310 serving as a transfer device is formed into a loop and entrained about a plurality of rollers. The transfer conveyor belt 310 is disposed opposite to the image forming units 1M, 1C, 1Y, and 1K. The transfer conveyor belt 310 delivers the recording medium P to a transfer nip N1 by absorbing the recording medium P to the surface thereof. The transfer conveyor belt 310 travels in the counterclockwise direction. Transfer rollers 350M, 350C, 350Y, and 350K are disposed inside the looped transfer conveyor belt 310, each facing the photoconductors 2M, 2C, 2Y, and 2K. The power source 39 applies the transfer bias to the transfer rollers 350M, 350C, 350Y, and 350K. The transfer rollers 350M, 350C, 350Y, and 350K contact the photoconductors 2M, 2C, 2Y, and 2K via the transfer conveyor belt 310. According to the present illustrative embodiment, the transfer nips N1 are formed at contact portions at which the photoconductors 2M, 2C, 2Y, and 2K contact the transfer conveyor belt 310.

According to the present illustrative embodiment, the photoconductors 2M, 2C, 2Y, and 2K are grounded, and the power source 39 applies the transfer bias to the transfer rollers 350M, 350C, 350Y, and 350K. With this configuration, a transfer electric field that electrostatically transfers toner images from the photoconductors 2M, 2C, 2Y, and 2K side to the transfer roller side is formed at the transfer nips N1.

The recording medium P is transported from the bottom right in FIG. 41, passing through between a sheet suction roller 351 and the transfer conveyor belt 310, and is absorbed to the transfer conveyor belt 310. Then, the recording medium P is transported to the transfer nips N1 of respective colors. The toner images on the photoconductors 2M, 2C, 2Y, and 2K are transferred onto the recording medium P at the transfer nips N1 due to the transfer electric field and the nip pressure.

According to the present illustrative embodiment, the transfer bias is applied to each of the transfer rollers 350M, 350C, 350Y, and 350K by the separate power sources 39. Alternatively, in some embodiments, a single power source 39 applies the transfer bias to each of the transfer rollers 350M, 350C, 350Y, and 350K.

Figure 42:
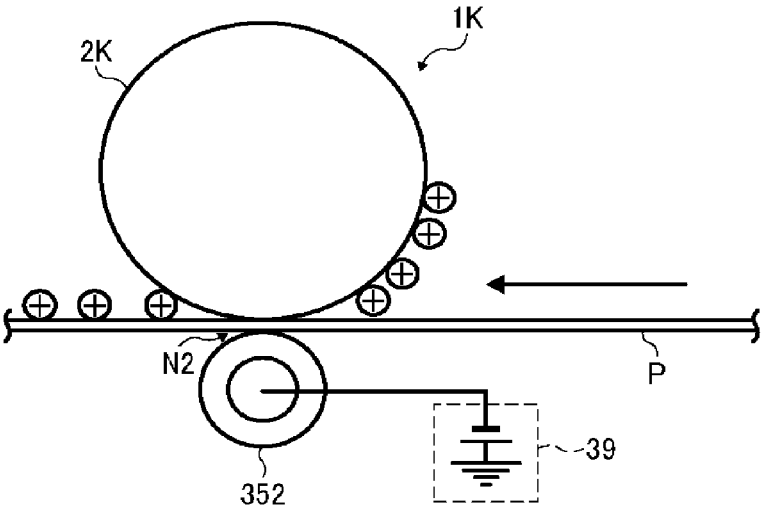
FIG. 42 is an enlarged schematic diagram illustrating an image forming unit 1K for black color and a power source in a monochrome image forming apparatus.

According to the illustrative embodiments described above, the present disclosure is applied to a color image forming apparatus that produces a color image. However, the present disclosure is not limited to the color image forming apparatus. For example, as illustrated in FIG. 42, the present disclosure can be applied to a monochrome image forming apparatus in which a transfer roller 352 serving as a transfer device is disposed opposite to the photoconductor 2K of the image forming unit 1K for black color.

The transfer roller 352 is constituted of a cored bar made of metal such as stainless steel and aluminum, and a resistance layer made of conductive sponge is disposed on the metal cored bar. In some embodiments, the transfer roller 352 includes a surface layer made of fluorocarbon resin or the like on top of the resistance layer.

The transfer roller 352 contacts the photoconductor 2K, thereby forming a transfer nip N therebetween. According to the present illustrative embodiment, the photoconductor 2K is grounded, and the power source 39 applies the transfer bias to the transfer roller 352. With this configuration, a transfer electric field that causes the toner image on the photoconductor 2K to electrostatically move to the transfer roller 352 side is formed between the transfer roller 352 and the photoconductor 2K. The toner image on the photoconductor 2K is transferred onto the recording medium P in the transfer nip N2 due to the transfer electric field and the nip pressure.

Figure 43:
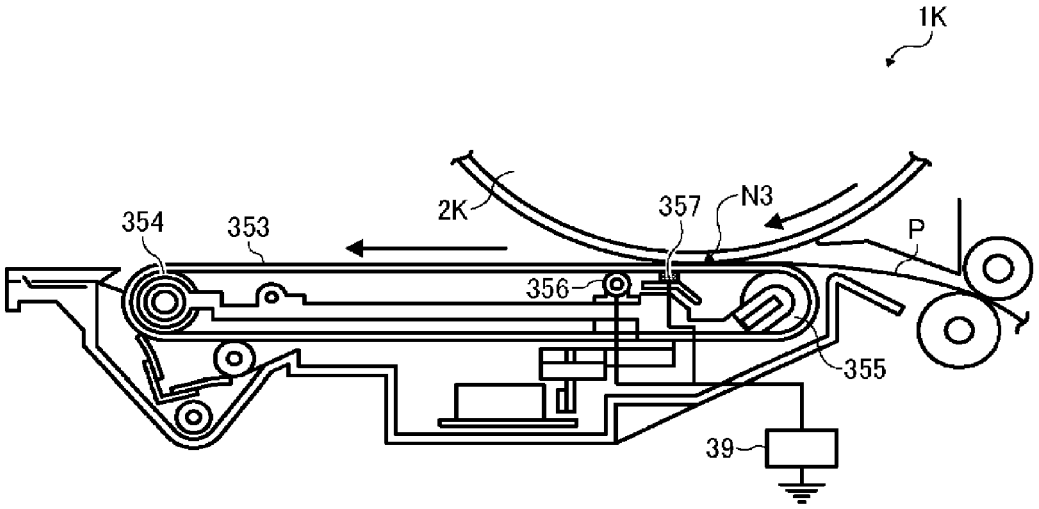
FIG. 43 is an enlarged schematic diagram illustrating another example of the transfer unit.

FIG. 43 shows an example of using a transfer conveyor belt 353 as a transfer device disposed opposite to the photoconductor 2K to contact the photoconductor 2K. The transfer conveyor belt 353 is entrained about a drive roller 354 and a driven roller 355, and is moved by the drive roller 354 in the direction of arrow in FIG. 43. The transfer conveyor belt 353 contacts the photoconductor 2K to form a transfer nip N3 between the drive roller 354 and the driven roller 355. The transfer conveyor belt 353 receives the recording medium P to be delivered to the transfer nip N3.

A transfer bias roller 356 and a bias application brush 357 are disposed inside the looped transfer conveyor belt 353. The transfer bias roller 356 and the bias application brush 357 are disposed downstream from the transfer nip N3 in the traveling direction of the transfer conveyor belt 353, and contact the inner surface of the transfer conveyor belt 353.

According to the present illustrative embodiment, the photoconductor 2K is grounded, and the power source 39 applies the transfer bias to the transfer bias roller 356 and the bias application brush 357. With this configuration, a transfer electric field that causes the toner image on the photoconductor 2K to electrostatically move to the transfer conveyor belt 353 side is formed at the transfer nip N3. The toner image on the photoconductor 2K is transferred onto the recording medium P transported by the transfer conveyor belt 353 to the transfer nip N3 due to the transfer electric field and the nip pressure.

According to the present illustrative embodiment, the image forming apparatus includes both the transfer bias roller 356 and the bias application brush 357 which contact the transfer conveyor belt 353. Alternatively, in some embodiments, the image forming apparatus includes at least one of the transfer bias roller 356 and the bias application brush 357. In some embodiments, the transfer bias roller 356 and/or the bias application brush 357 is disposed below the transfer nip N3.

Similar to the foregoing embodiments, in the image forming apparatuses illustrated in FIGS. 40 and 43, the controller 60 adjusts the time-averaged value Vave of the voltage of the secondary transfer bias (the transfer bias) to be at the transfer direction side relative to the midpoint voltage value Voff which is a midpoint value of the voltage intermediate between the maximum and the minimum values of the secondary transfer bias (transfer bias). With this configuration, the range of successful transfer of toner increases, and hence sufficient image density can be achieved in both recessed and projecting portions of the surface of a recording medium even when parameters of sheet types, image patterns, environmental conditions, and so forth change, while preventing image defects such as dropouts and white spots. Accordingly, a good output image can be obtained.

According to an aspect of this disclosure, the present invention is employed in the image forming apparatus. The image forming apparatus includes, but is not limited to, an electrophotographic image forming apparatus, a copier, a printer, a facsimile machine, and a multi-functional system, also known as multifunction peripheral.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer to bear a toner image on a surface thereof;

a transfer device to contact the image bearer to form a transfer nip;

a power source to output a voltage to transfer the toner image from the image bearer onto a recording medium interposed in the transfer nip, the voltage including a first voltage in a transfer direction in which the toner image is transferred from the image bearer to the recording medium and a second voltage having a polarity opposite that of the first voltage, and the first voltage and the second voltage alternating upon transfer of the toner image from the image bearer to the recording medium; and a controller operatively connected to the power source to control the power source;

wherein a time-averaged value (Vave) of the voltage has a polarity in the transfer direction, and an absolute value of the time-averaged value (Vave) is greater than a midpoint value (Voff) of the voltage intermediate between a maximum value and a minimum value of the voltage, wherein with an increase in a difference (Vpp) between the maximum value and the minimum value of the voltage, the controller controls the power source to increase a duty ratio (Duty) expressed by B/(A+B), where B is an application time in one cycle at a return direction side opposite a transfer direction side relative to the midpoint value (Voff) and A is an application time at the transfer direction side relative to the midpoint value (Voff), and with a decrease in the difference (Vpp), the controller controls the power source to reduce the duty ratio (Duty).

2. The image forming apparatus according to claim 1, further comprising a waveform detector to detect a waveform of the voltage output from the power source, wherein based on the waveform detected by the waveform detector, the controller controls the power source to increase the duty ratio (Duty) with an increase in the difference (Vpp) and to reduce the duty ratio (Duty) with a decrease in the difference (Vpp).

3. The image forming apparatus according to claim 1, wherein the controller controls the power source to increase the duty ratio (Duty) with an increase in roughness of the recording medium.

4. The image forming apparatus according to claim 1, wherein the controller controls the power source to increase the duty ratio (Duty) with an increase in thickness of the recording medium.

5. The image forming apparatus according to claim 1, further comprising an environment detector to detect at least one of temperature and humidity, wherein the controller controls the power source to increase the duty ratio (Duty) with a decrease in at least one of the temperature and the humidity detected by the environment detector.

6. The image forming apparatus according to claim 1, further comprising a resistance detector to detect an electrical resistance of a transfer portion, wherein the controller controls the power source to increase the duty ratio (Duty) with an increase in the electrical resistance detected by the resistance detector.

7. An image forming apparatus, comprising:

an image bearer to bear a toner image on a surface thereof;

a power source to output an oscillation voltage to transfer the toner image from the image bearer onto a recording medium;

a waveform setting device to set a waveform of the oscillation voltage, the waveform setting device setting the waveform to increase a time ratio expressed by Y/X with an increase in a voltage difference (Vpp) between a maximum value of the waveform and a minimum value of the waveform, where X is a cycle of the waveform and Y is a time during which the waveform has a polarity causing the toner image to return from the recording medium to the image bearer in the cycle X; and a controller operatively connected to the power source to control an output of the power source including the oscillation voltage based on the waveform set by the waveform setting device.

8. The image forming apparatus according to claim 7, wherein the controller controls the power source to increase the time ratio with an increase in roughness of the recording medium.

9. The image forming apparatus according to claim 7, wherein the controller controls the power source to increase the time ratio with an increase in thickness of the recording medium.

10. The image forming apparatus according to claim 7, further comprising an environment detector to detect at least one of temperature and humidity, wherein the controller controls the power source to increase the time ratio with a decrease in at least one of the temperature and the humidity detected by the environment detector.

11. The image forming apparatus according to claim 7, further comprising a resistance detector to detect an electrical resistance of a transfer portion, wherein the controller controls the power source to increase the time ratio with an increase in the electrical resistance detected by the resistance detector.

12. An image forming apparatus, comprising:

an image bearer to bear a toner image on a surface thereof;

a transfer device to contact the image bearer to form a transfer nip;

a power source to output a voltage to transfer the toner image from the image bearer onto a recording medium interposed in the transfer nip, the voltage including a first voltage in a transfer direction in which the toner image is transferred from the image bearer to the recording medium and a second voltage having a polarity opposite that of the first voltage, and the first voltage and the second voltage alternating upon transfer of the toner image from the image bearer to the recording medium; and a controller operatively connected to the power source to control the power source, wherein with an increase in thickness of the recording medium, the controller controls the power source to increase a duty ratio (Duty) expressed by B/(A+B), where B is an application time in one cycle at a return direction side opposite a transfer direction side relative to a midpoint value (Voff) of the voltage intermediate between a maximum value and a minimum value of the voltage, and A is an application time at the transfer direction side relative to the midpoint value (Voff).

13. The image forming apparatus according to claim 12, wherein a time-averaged value (Vave) of the voltage has a polarity in the transfer direction, and an absolute value of the time-averaged value (Vave) is greater than the midpoint value (Voff).

* * * * *